US007211553B2

(12) United States Patent
Subawalla et al.

(10) Patent No.: US 7,211,553 B2
(45) Date of Patent: May 1, 2007

(54) PROCESSING OF SUBSTRATES WITH DENSE FLUIDS COMPRISING ACETYLENIC DIOLS AND/OR ALCOHOLS

(75) Inventors: Hoshang Subawalla, Macungie, PA (US); Gene Everad Parris, Coopersburg, PA (US); Madhukar Bhaskara Rao, Fogelsville, PA (US); Christine Peck Kretz, Macungie, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 121 days.

(21) Appl. No.: 10/737,203

(22) Filed: Dec. 16, 2003

(65) Prior Publication Data

US 2005/0029490 A1 Feb. 10, 2005

Related U.S. Application Data

(63) Continuation-in-part of application No. 10/635,046, filed on Aug. 5, 2003, now abandoned.

(51) Int. Cl.
*C11D 7/32* (2006.01)

(52) U.S. Cl. ..... 510/175; 510/176; 510/506; 134/3; 8/142

(58) Field of Classification Search ..... None
See application file for complete search history.

(56) References Cited

U.S. PATENT DOCUMENTS

| | | | |
|---|---|---|---|
| 4,944,837 | A | 7/1990 | Nishikawa et al. |
| 4,992,308 | A | 2/1991 | Sunol |
| 5,013,366 | A | 5/1991 | Jackson et al. |
| 5,158,704 | A | 10/1992 | Fulton et al. |
| 5,236,602 | A | 8/1993 | Jackson |
| 5,266,205 | A | 11/1993 | Fulton et al. |
| 5,355,901 | A | 10/1994 | Mielnik et al. |
| 5,370,740 | A | 12/1994 | Chao et al. |
| 5,377,705 | A | 1/1995 | Smith, Jr. et al. |
| 5,417,768 | A | 5/1995 | Smith, Jr. et al. |
| 5,494,526 | A | 2/1996 | Paranjpe |
| 5,522,938 | A | 6/1996 | O'Brien |
| 5,533,538 | A | 7/1996 | Marshall |
| 5,733,964 | A | 3/1998 | Johnston et al. |
| 5,783,082 | A | 7/1998 | DeSimone et al. |
| 5,789,505 | A | 8/1998 | Wilkinson et al. |
| 5,866,004 | A | 2/1999 | Houck et al. |
| 5,866,005 | A | 2/1999 | DeSimone et al. |
| 5,868,856 | A | 2/1999 | Douglas et al. |
| 5,872,257 | A | 2/1999 | Beckman et al. |
| 5,873,948 | A | 2/1999 | Kim |
| 5,908,510 | A | 6/1999 | McCullough et al. |

(Continued)

FOREIGN PATENT DOCUMENTS

| | | |
|---|---|---|
| EP | 0 830 890 | 3/1998 |

(Continued)

OTHER PUBLICATIONS

K. Jackson, et al., "Microemulsions in Supercritical Hydrochlorofluorocarbons," Langmuir 12(22), pp. 5289-5295 (1996).

(Continued)

*Primary Examiner*—Gregory Webb
(74) *Attorney, Agent, or Firm*—Rosaleen P. Morris-Oskanian; Joseph D. Rossi

(57) ABSTRACT

A dense cleaning fluid for removing contaminants from a substrate and a method comprising same is disclosed herein. In one embodiment of the present invention, the dense cleaning fluid comprises a dense fluid and at least one acetylenic diol or acetylenic alcohol surfactant.

14 Claims, 4 Drawing Sheets

U.S. PATENT DOCUMENTS

| | | | | |
|---|---|---|---|---|
| 5,944,996 | A | 8/1999 | DeSimone et al. | |
| 5,976,264 | A | 11/1999 | McCullough et al. | |
| 6,024,801 | A | 2/2000 | Wallace et al. | |
| 6,113,708 | A | 9/2000 | Hopple et al. | |
| 6,176,895 | B1 | 1/2001 | DeSimone et al. | |
| 6,224,774 | B1 | 5/2001 | DeSimone et al. | |
| 6,228,563 | B1 | 5/2001 | Starov et al. | |
| 6,240,936 | B1 | 6/2001 | DeSimone et al. | |
| 6,242,165 | B1 | 6/2001 | Vaartstra | |
| 6,270,531 | B1 | 8/2001 | DeYoung et al. | |
| 6,277,753 | B1 | 8/2001 | Mullee et al. | |
| 6,286,231 | B1 | 9/2001 | Bergman et al. | |
| 6,297,206 | B2 | 10/2001 | Romack et al. | |
| 6,306,564 | B1 | 10/2001 | Mullee | |
| 6,331,487 | B2 | 12/2001 | Koch | |
| 6,333,268 | B1 | 12/2001 | Starov et al. | |
| 6,344,243 | B1 | 2/2002 | McClain et al. | |
| 6,357,142 | B1 | 3/2002 | Bergman et al. | |
| 6,403,544 | B1 | 6/2002 | Davenhall et al. | |
| 6,454,869 | B1 | 9/2002 | Cotte et al. | |
| 6,500,605 | B1 | 12/2002 | Mullee et al. | |
| 6,506,259 | B1 | 1/2003 | Romack et al. | |
| 6,589,355 | B1 | 7/2003 | Thomas et al. | |
| 2001/0023237 | A1* | 9/2001 | Bijl et al. | 510/367 |
| 2002/0026729 | A1 | 3/2002 | Bergman et al. | |
| 2002/0055323 | A1 | 5/2002 | McClain et al. | |
| 2002/0088477 | A1 | 7/2002 | Cotte et al. | |
| 2002/0112747 | A1 | 8/2002 | DeYoung et al. | |
| 2003/0003762 | A1 | 1/2003 | Cotte et al. | |
| 2004/0055621 | A1* | 3/2004 | McDermott et al. | 134/1.3 |
| 2004/0055624 | A1* | 3/2004 | McDermott et al. | 134/26 |
| 2004/0068027 | A1* | 4/2004 | Daly et al. | 522/111 |
| 2004/0144399 | A1* | 7/2004 | McDermott et al. | 134/1 |
| 2005/0029490 | A1* | 2/2005 | Subawalla et al. | 252/79 |
| 2005/0029492 | A1* | 2/2005 | Subawalla et al. | 252/79.4 |

FOREIGN PATENT DOCUMENTS

| | | | |
|---|---|---|---|
| EP | 0 836 895 | A2 | 4/1998 |
| EP | 1 050 577 | | 11/2000 |
| EP | 1 115 035 | | 7/2001 |
| EP | 1 402 963 | | 3/2004 |
| WO | WO 84/02291 | | 6/1984 |
| WO | WO 99/49996 | | 10/1999 |
| WO | WO 99/49998 | | 10/1999 |
| WO | WO 99/61177 | | 12/1999 |
| WO | WO 00/16264 | | 3/2000 |
| WO | WO 00/26421 | | 5/2000 |
| WO | WO 01/21616 | | 3/2001 |
| WO | WO 01/32323 | A1 | 5/2001 |
| WO | WO 01/33613 | A2 | 5/2001 |
| WO | WO 01/60534 | A1 | 8/2001 |
| WO | WO 01/87505 | | 11/2001 |
| WO | WO 02/11191 | | 2/2002 |
| WO | WO 02/15251 | A1 | 2/2002 |
| WO | WO 02/66176 | | 8/2002 |
| WO | WO 03/057811 | | 7/2003 |
| WO | WO 2005/038898 | A1 | 4/2005 |

OTHER PUBLICATIONS

M. A. Biberger, et al., "Photoresist and Photoresist Residue Removal with Supercritical $CO_2$—A Novel Approach to Cleaning Wafers," Semiconductor Fabtech, 12th Ed., pp. 239-243.

D. Beery, et al., "Post Etch Residue Removal: Novel Dry Clean Technology Using Densified Fluid Cleaning (DFC)," IITC 99, pp. 140-142.

J. Liu, et al., "Investigation of Nonionic Surfactant Dynol-604 Based Reverse Microemulsions Formed in Supercritical Carbon Dioxide," Langmuir 17, pp. 8040-8043 (2001).

K. Jackson, et al., "Surfactants and Microemulsions in Supercritical Fluids," Supercritical Fluid Cleaning, pp. 87-120.

R. A. Bowling, et al., "Future Challenges for Cleaning in Advanced Microelectronics," Texas Instruments slides.

H. J. Martinez, et al., "$SCCO_2$—Is it an Enabling Technology for the 90nm Node and Beyond?" International SeMatech slides (2002).

S. Pawat, "Novel Wafer Clean Technologies," International SeMatech slides (2001).

T. Hurd, et al., "$scCO_2$ Cleaning Applications in Porous ULK Processing," Texas Instruments slides.

G. L. Weibel, et al., "Supercritical $CO_2$ in Microelectronics Processing," Cornell University slides.

J. B. Rubin, et al., "Precision Cleaning of Semiconductor Surfaces Using Carbon Dioxide-Based Fluids," Clarkson University, pp. 1-26.

G. Weibel, "Supercritical $CO_2$ for Semiconductor Applications," Semiconductor Equipment and Materials International (2001).

J. Malloy, et al., "GC Analysis of Solvent Wash Samples," Air Products and Chemicals, Inc. (2003).

Carpenter, B.A. et al., Supercritical Fluid Extraction and Chromatography, *ACS Symposium Series 366*, Apr. 5-10, 1987, Denver, CO.

Devittori, C. et al., Article at http://mpi.powerultrasonics.com/cleaning-co2,html, "Multifrequency ultrasonic Actuators with Special Application to Ultrasonic Cleaning in Liquid and Supercritical CO2".

Enokida, Y. et al., "Ultrasound-Enhanced Dissolution of UO2 in Supercritical CO2 Containing a CO2-Philic Complexant of Tri-n-Butylphosphate and Nitric Acid", *Industrial & Engineering Chemistry Research*, (2002), 41 (9), pp. 2282-2286.

* cited by examiner

PROCESSING OF SUBSTRATES WITH DENSE FLUIDS COMPRISING ACETYLENIC DIOLS AND/OR ALCOHOLS

CROSS-REFERENCE TO RELATED APPLICATIONS

This application is a continuation-in-part of U.S. patent application Ser. No. 10/635,046, filed 5 Aug. 2003 now abandoned the disclosure of which is incorporated herein by reference in its entirety.

BACKGROUND OF THE INVENTION

Small quantities of contaminants are detrimental to the microchip fabrication process in the manufacturing of semiconductor electronic components. Contaminants may be introduced into the component from many sources such as residues from manufacturing process steps such as lithography, etching, stripping, and chemical mechanical planarization (CMP); particulates either indigenous to and/or resulting from manufacturing processes; inorganic particulates or materials such as native or chemical oxides, metal-containing compounds; or other sources. Contaminants, in the form of particulates, films, or molecules, can cause a variety of defects, such as short circuits, open circuits, and silicon crystal stacking faults. These defects can cause the failure of the finished component, such as microelectronic circuits, and these failures can cause significant yield reductions, which greatly increases manufacturing costs.

Microelectronic circuit fabrication requires many processing steps. Processing is performed under extremely clean conditions and the amount of contamination needed to cause fatal defects in microcircuits is extremely small. For example, an individual particle as small as 0.01 micrometer in size can result in a killer defect in a modern microcircuit. Microcontamination may occur at any time during the many steps needed to complete the microcircuit. Therefore, periodic cleaning of the components used for microelectronic circuits, such as wafers, is needed to maintain economical yields. Also, tight control of purity and cleanliness of the processing materials is required.

Cleaning is the most frequently repeated step in the manufacture of microelectronic circuits. At the 0.18-micrometer design rule, 80 of the approximately 400 total processing steps are cleaning steps. Wafers typically are cleaned after every contaminating process step and before each high temperature operation to ensure the quality of the circuit. Exemplary cleaning and removal applications include photoresist stripping/removal, particle/residue removal for post-chemical mechanical planarization (post-CMP cleaning), particle/residue removal for post-dielectric etching (or post-metal etching), and removal of metal contaminants.

Numerous cleaning methods have been used in the manufacture of semiconductor electronic components. These include immersion in liquid cleaning agents to remove contamination through dissolution and chemical reaction. Such immersion may also serve to reduce the van der Waals adhesive forces and introduce double layer repulsion forces, thereby promoting the release of insoluble particles from surfaces. A standard wet cleaning process in common use begins with exposure to a mixture of $H_2SO_4$, $H_2O_2$, and $H_2O$ at 110–130° C., and is followed by immersion in HF or dilute HF at 20–25° C. Next, a mixture of $NH_4OH$, $H_2O_2$, and $H_2O$ at 60–80° C. removes particles and then a mixture of HCl, $H_2O_2$, and $H_2O$ at 60–80° C. removes metal contamination. Each of these steps is followed by a high purity $H_2O$ rinse. This wet cleaning process reaches fundamental barriers at dimensions less than 0.10 micrometer. As the device geometries shrink and gate oxide thickness decreases, sub-micrometer particle removal becomes increasingly difficult.

Stripping/removal of primarily organic photoresist may be performed using dilute aqueous mixtures containing $H_2SO_4$ and $H_2O_2$. Alternatively, the stripping/removal may be performed using a two-step plasma, or reactive ion etching (RIE) process, followed by wet chemical cleaning of the residue material. Ozonated $H_2O$ has been used for the decomposition of hydrocarbon surface contaminants on silicon wafers.

Brush scrubbing has been used to enhance the liquid immersion process by introducing hydrodynamic shear forces to the contaminated surfaces. A typical application uses a wafer cleaning apparatus comprising two opposed brushes for brushing a vertically disposed wafer in a tank that can contain a process liquid.

The addition of ultrasonic energy can increase the effectiveness of the liquid immersion process. Sound waves vibrating at frequencies greater than 20,000 cycles per second (20 KHz), i.e., beyond the range of human hearing, have been used to transmit high frequency energy into liquid cleaning solutions.

Wet processing methods may become problematic as microelectronic circuit dimensions decrease and as environmental restrictions increase. Among the limitations of wet processing are the progressive contamination of re-circulated liquids, re-deposition from contaminated chemicals, special disposal requirements, environmental damage, special safety procedures during handling, reduced effectiveness in deeply patterned surfaces due to surface tension effects and image collapse (topography sensitivity), dependence of cleaning effectiveness on surface wet-ability to prevent re-adhesion of contaminants, and possible liquid residue causing adhesion of remaining particles. Aqueous cleaning agents that depend upon chemical reaction with surface contaminants may also present compatibility problems with new thin film materials or with more corrosion-prone metals such as copper. Further, aqueous cleaning agents may introduce hydroxyl groups in porous low and ultralow dielectric constant materials, which may increase the dielectric constant of the material. In addition, the International Technology Roadmap for Semiconductors has recommended a 62% reduction in water use by the year 2005 and an 84% reduction by the year 2014 to prevent water shortages. With the continuing trend toward increasing wafer diameters having a larger precision surface area, larger volumes of liquid chemicals will be required in the fabrication process.

In view of these problems, methods for dry (anhydrous) surface cleaning of semiconductor electronic components are being developed. Among these is gas jet cleaning to remove relatively large particles from silicon wafers. However, gas jets can be ineffective for removing particles smaller than about 5 micrometers in diameter because the forces that hold particles on the surface are proportional to the particle size, while the aerodynamic drag forces generated by the flowing gas for removing the particles are proportional to the particle diameter squared. Therefore, the ratio of these forces tends to favor adhesion as the particle size shrinks. In addition, smaller particles are not exposed to strong drag forces in the jet since they normally lie within the surface boundary layer where the gas velocity is low.

Exposure to ozone combined with ultraviolet light can be used to decompose contaminating hydrocarbons from surfaces, but this technique has not been shown to remove inorganic contaminants or particles effectively.

Other alternatives to wet cleaning include the use of jets containing snow or pellet projectiles comprising frozen Ar, $N_2$, $H_2O$ or $CO_2$, which are used to "sandblast" contaminated surfaces. In these processes, pressurized gaseous or gas/liquid mixtures are expanded in a nozzle to a pressure near or below atmospheric pressure. The resulting Joule-Thomson cooling forms solid or liquid aerosol particles, which traverse the boundary layer and strike the contaminated surface. This technique requires extremely clean and pure processing materials. Trace molecular contaminants (e.g., hydrocarbons) in the feed gases can condense into solid particulates or droplets upon expansion, causing deposition of new contaminants on the surface. Although useful in providing removal of many surface contaminants, these processes cannot remove all of the important contaminants present on a wafer surface, and have not yet found wide acceptance in the semiconductor industry.

Immersion in supercritical fluids is another alternative to wet cleaning. The effectiveness of supercritical fluids in various cleaning and extraction applications is well established and extensively documented. The solvency of supercritical fluids is much greater than the corresponding gaseous state; thus, supercritical fluids can effectively dissolve and remove unwanted films and molecular contaminants from a precision surface. The contaminants can be separated from the cleaning agent by a reduction in pressure below the critical value, which concentrates the contaminants for disposal and permits recovery and re-use of the cleaning fluid.

Supercritical $CO_2$ in particular has been used as a versatile and cost effective method to overcome the above-mentioned problems in wafer cleaning. Supercritical $CO_2$ effectively cleans parts with increasingly smaller dimensions and lowers water usage, thereby yielding improvements in performance and environmental benefits. Preliminary Cost of Ownership (CoO) studies have shown that supercritical $CO_2$ cleaning is also more cost effective when compared to aqueous cleaning. However, while liquid/supercritical $CO_2$ by itself may be capable of dissolving primarily non-polar species, monomers and low molecular weight organic polymers, other species such as inorganic and/or polar compounds and high molecular weight polymers are not easily dissolved in either liquid or supercritical $CO_2$. To remedy this lack of solvency, entrainers such as co-solvents and surfactants are added to the liquid or supercritical $CO_2$ to increase contaminant solubility and thereby widen the range of contaminants that can be removed.

A wide variety of cosolvents, chelating agents and surfactants have been used/proposed for use with $CO_2$ for semiconductor substrate cleaning. These include specific esters, ethers, alcohols, glycols, ketones, amines, amides, carbonates, carboxylic acids, alkane diols, alkanes, hydrogen peroxide, and chelating agents. Fluorinated and silicone-based surfactants have traditionally been used with liquid or supercritical $CO_2$ for wafer cleaning applications because of their high solubility in $CO_2$. These surfactants, however, are generally expensive and may increase overall processing costs.

Future microcircuits will have smaller feature sizes and greater complexities, and will require more processing steps in their fabrication. Contamination control in the process materials systems and processing environment will become even more critical. In view of these anticipated developments, there is a need for improved wafer cleaning methods to maintain or improve economical yields in the manufacture of these smaller and more complex microelectronic systems. In addition, the advent of smaller feature sizes and greater complexities will require improved fabrication processes steps including etching, thin film deposition, planarization, and photoresist development. Embodiments of the present invention, which are described below and defined by the following claims, address this need by improved processing methods utilizing dense cleaning fluids comprising lower cost, acetylenic alcohol or acetylenic diol processing agents and/or nitriles.

BRIEF SUMMARY OF THE INVENTION

The present invention provides a dense cleaning fluid for removing contaminants from a substrate and a method comprising same. In one aspect of the present invention, there is provided a dense cleaning fluid comprising: a dense fluid and at least one acetylenic diol or acetylenic alcohol represented by the following formulas A or B:

Formula A

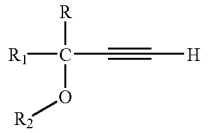

Formula B

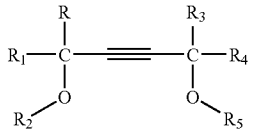

wherein R, $R_1$, $R_3$, and $R_4$ are independently a hydrogen atom, a linear alkyl group comprised of from 1 to 34 carbon atoms, a branched alkyl group comprised of from 2 to 34 carbon atoms, and $R_2$ and $R_5$ are each independently a hydrogen atom; a hydroxyl terminated poly(alkylene oxide) chain derived from 1 to 30 alkylene oxide monomer units of the following Formula C:

Formula C

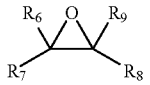

wherein $R_6$, $R_7$, $R_8$, and $R_9$ are independently a hydrogen atom, a linear alkyl group comprised of from 1 to 5 carbon atoms, a branched alkyl group comprised of from 2 to 5 carbon atoms, or a cyclic alkyl group comprised of from 3 to 5 carbon atoms; an interactive functional group; and combinations thereof.

In another aspect of the present invention, there is provided a dense cleaning fluid comprising: a dense fluid, at least one acetylenic diol or acetylenic alcohol represented by the aforementioned Formulas A or B; and at least one processing agent selected from the group consisting of a co-solvent, a surfactant, a chelating agent, and combinations thereof.

In a further aspect of the present invention, there is provided a dense cleaning fluid for removing contaminants from a substrate comprising: from 20 to 99 weight percent of a dense fluid; from 1 to 20 weight percent of at least one acetylenic alcohol or acetylenic diol represented by the aforementioned Formulas A or B; 0 to 40 weight percent of at least one cosolvent; and 0 to 20 weight percent of at least one chelating agent.

In yet another aspect of the present invention, there is provided a dense cleaning fluid for removing contaminants from a substrate comprising: a dense fluid and at least one derivatized acetylenic alcohol or derivatized acetylenic diol wherein the derivatized alcohol or the derivatized diol comprises at least one interactive functional group selected from the group consisting of an amine and acid functional group; an ester functional group; an ether and alcohol functional group; an ester and alcohol functional group; a nitrile functional group; a carbonate functional group; and combinations thereof.

In a still further aspect of the present invention, there is provided a method for removing contaminants from a substrate comprising: contacting the substrate with a dense cleaning fluid comprising a dense fluid and at least one acetylenic diol or acetylenic alcohol represented by the aforementioned Formulas A or B.

In another aspect of the present invention, there is provided a method for removing contaminants from a substrate comprising: introducing the substrate comprising contaminants into a processing chamber; contacting the substrate with a dense cleaning fluid comprising a dense fluid and at least one processing agent selected from the group consisting of an acetylenic alcohol, an acetylenic diol, a derivatized acetylenic alcohol, a derivatized acetylenic diol, a cosolvent, a chelating agent, a surfactant, and combinations thereof to provide a spent dense processing fluid and a treated substrate; and separating the contaminants and the at least one processing agent from the spent dense processing fluid.

These and other aspects of the present invention are provided in the Detailed Description of the Invention.

DETAILED DESCRIPTION OF THE INVENTION

Figure 1:
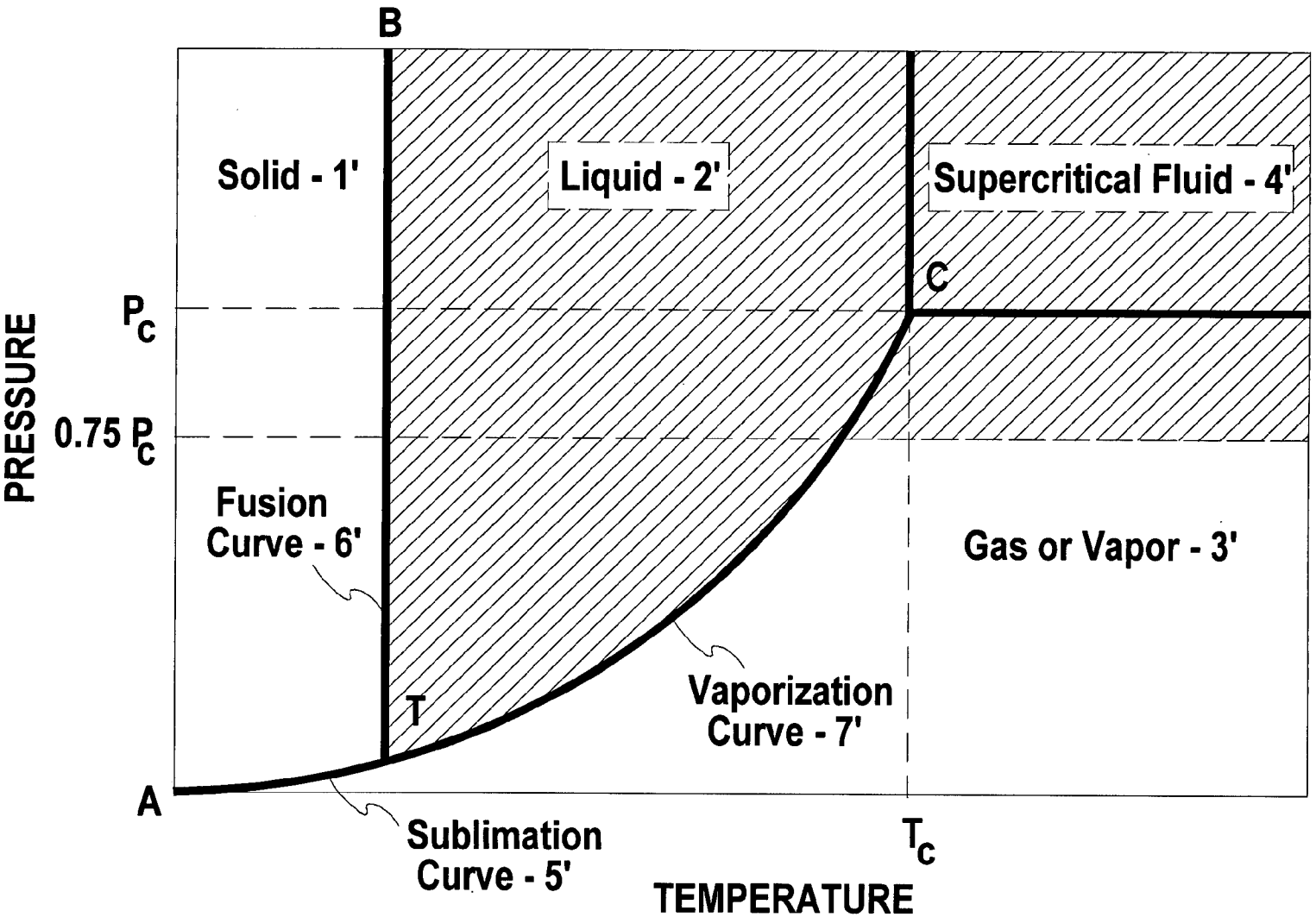
FIG. 1 is a pressure-temperature phase diagram for a single component supercritical fluid.

Dense fluids, particularly supercritical fluids, are well suited to convey processing agents to an articles or substrate such as, for example, microelectronic components undergoing processing steps and for removing undesirable contaminants from the microelectronic components upon completion of various process steps. These process steps typically are carried out batchwise and may include cleaning, film stripping, etching, deposition, drying, and planarization. Other uses for supercritical fluids include precipitation of nano-particles and suspension of metallic nano-crystals. It is envisioned that the dense cleaning fluids of the present invention may replace aqueous and organic-solvent based formulations that have traditionally been used to remove organic, inorganic and metallic residue from an article or substrate, and prepare the article or substrate for further processing.

A wide variety of contamination-sensitive articles encountered in the fabrication of microelectronic devices and micro-electromechanical devices can be cleaned or processed using embodiments of the present invention. The term "substrate" as used herein means any article of manufacture that can be contacted with a dense fluid or a dense cleaning fluid. Such articles may include, for example, semiconductor substrates such as silicon or gallium arsenide wafers, reticles, photomasks, flat panel displays, internal surfaces of processing chambers, printed circuit boards, surface mounted assemblies, electronic assemblies, sensitive wafer processing system components, electro-optical, laser and spacecraft hardware, surface micro-machined systems, and other related articles subject to contamination during fabrication.

Dense fluids are ideal for removal of contaminants, particularly in microelectronic applications, because these fluids characteristically have high solvent power, low viscosity, high diffusivity, and negligible surface tension relative to the substrates being processed. In a cleaning process involving substrates useful for microelectronic devices, typical contaminants to be removed from these substrates may include, for example, organic compounds such as exposed photoresist material, photoresist residue, UV- or X-ray-hardened photoresist, C—F-containing polymers, low and high molecular weight polymers, and other organic etch residues; inorganic compounds such as metal oxides, ceramic particles from CMP slurries and other inorganic etch residues; metal containing compounds such as organometallic residues and metal organic compounds; ionic and neutral, light and heavy inorganic (metal) species, moisture, and insoluble materials, including particles generated by planarization and sputter etch processes. The processing fluids used in microelectronic processing typically have high purity, much higher than that of similar fluids used in other applications, to avoid further introduction of contaminants. In this connection, the purification of extremely high purity fluids for these applications should be done with great care.

The term "processing" or "processed" as used herein means contacting a substrate with a dense fluid or a dense cleaning fluid to effect physical and/or chemical changes to the substrate. Depending upon the application, the term "processing" may include, for example, film stripping, cleaning, drying, etching, planarization, deposition, extraction, photoresist development, or formation of suspended nano-particles and nano-crystals.

FIG. 1 is a pressure-temperature phase diagram for a single component supercritical fluid. The term "component" as used herein means an element (for example, hydrogen, helium, oxygen, nitrogen) or a compound (for example, carbon dioxide, methane, nitrous oxide, sulfur hexafluoride). Referring to FIG. 1, four distinct regions or phases, solid 1', liquid 2', gas 3' and supercritical fluid 4', exist for a single component. The critical point, designated "C" in FIG. 1, is defined as that pressure (critical pressure $P_c$) and temperature (critical temperature $T_c$) below which a single component can exist in vapor/liquid equilibrium. The density of the single component at the critical point is its critical density. Also shown in FIG. 1 are the sublimation curve 5', or the line between "A" and "T" which separates the solid 1' and gas 3' regions, the fusion curve 6', or the line between "T" and "B" which separates the liquid 2' and solid 1' regions, and the vaporization curve 7', or the line between "T" and "C" which separates the liquid 2' and gas 3' regions. The three curves meet at the triple point, designated "T", wherein the three phases, or solid, liquid and gas, coexist in equilibrium. A phase is generally considered a liquid if it can be vaporized by reducing pressure at constant temperature. Similarly, a phase is considered a gas if it can be condensed by reducing the temperature at a constant pressure. The gas and liquid regions become indistinguishable at or above the critical point C, as shown in FIG. 1.

A single-component supercritical fluid is defined as a fluid at or above its critical temperature and pressure. A related single-component fluid having similar properties to the single-component supercritical fluid is a single-phase fluid which exists at a temperature below its critical temperature and a pressure above its liquid saturation pressure. An additional example of a single-component dense fluid may be a single-phase fluid at a pressure above its critical pressure or a pressure above its liquid saturation pressure. A single-component subcritical fluid is defined as a fluid at a temperature below its critical temperature or a pressure below its critical pressure or alternatively a pressure P in the range $0.75P_c \leqq P \leqq P_c$ and a temperature above its vapor saturation temperature. In the present disclosure, the term "dense fluid" as applied to a single-component fluid is defined to include a supercritical fluid, a single-phase fluid which exists at a temperature below its critical temperature and a pressure above its liquid saturation pressure, a single-phase fluid at a pressure above its critical pressure or a pressure above its liquid saturation pressure, and a single-component subcritical fluid. An example of a single component dense fluid is shown as the thatched region in FIG. 1.

Figure 2:
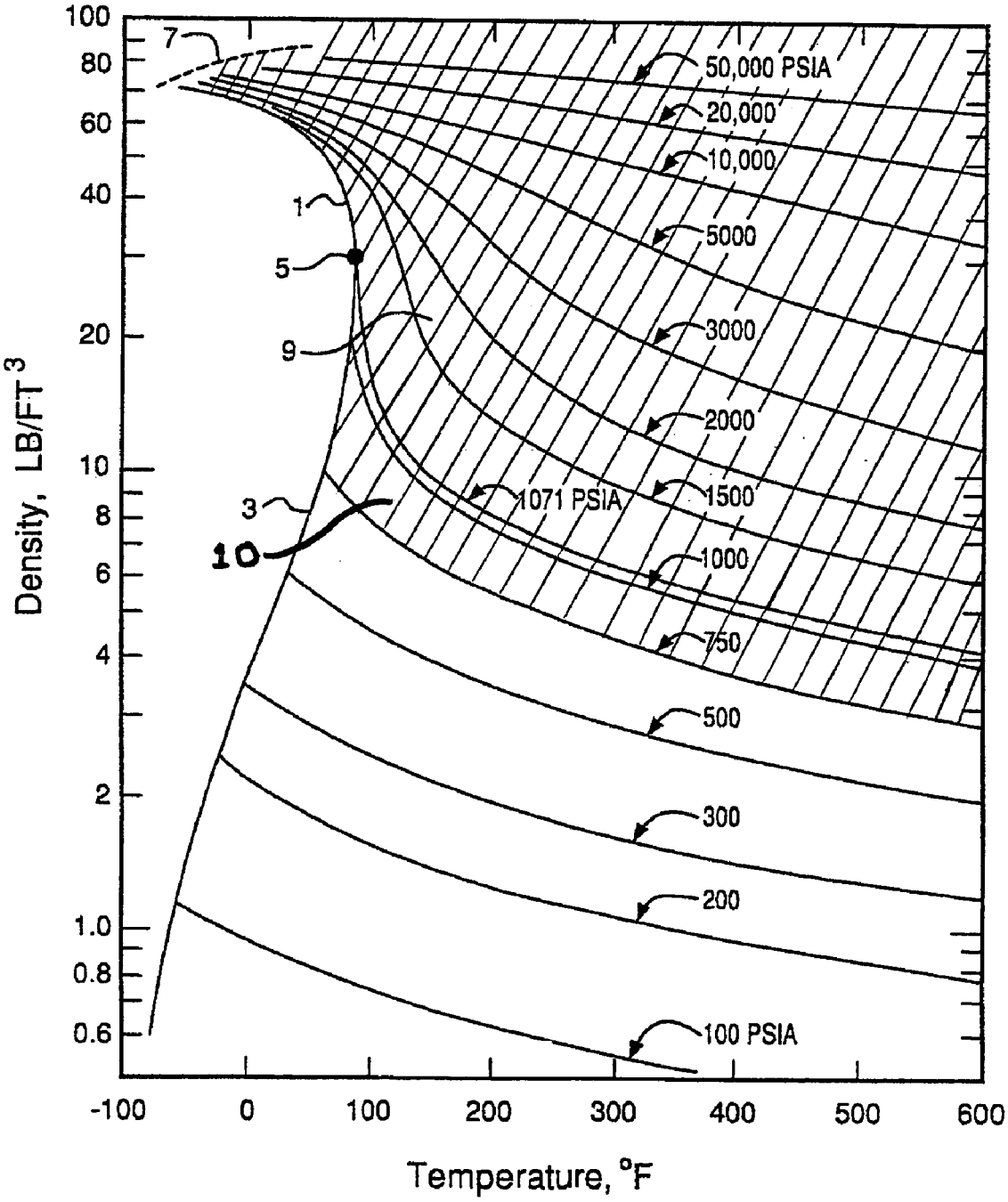
FIG. 2 is a density-temperature phase diagram for $CO_2$.

An example of a dense fluid for a single component is illustrated in FIG. 2, which is a representative density-temperature phase diagram for carbon dioxide. This diagram shows saturated liquid curve 1 and saturated vapor curve 3, which merge at critical point 5 at the critical temperature of 87.9° F. (31.1° C.) and critical pressure of 1,071 psia. Lines of constant pressure (isobars) are shown, including the critical isobar of 1,071 psia. Line 7 is the melting curve. The region to the left of and enclosed by saturated liquid curve 1 and saturated vapor curve 3 is a two-phase vapor-liquid region. The region outside and to the right of saturated liquid curve 1, saturated vapor curve 3, and melting curve 7 is a single-phase fluid region. The dense fluid as defined herein is indicated by cross-thatched regions 9 (at or above critical pressure) and 10 (below critical pressure).

Figure 3:
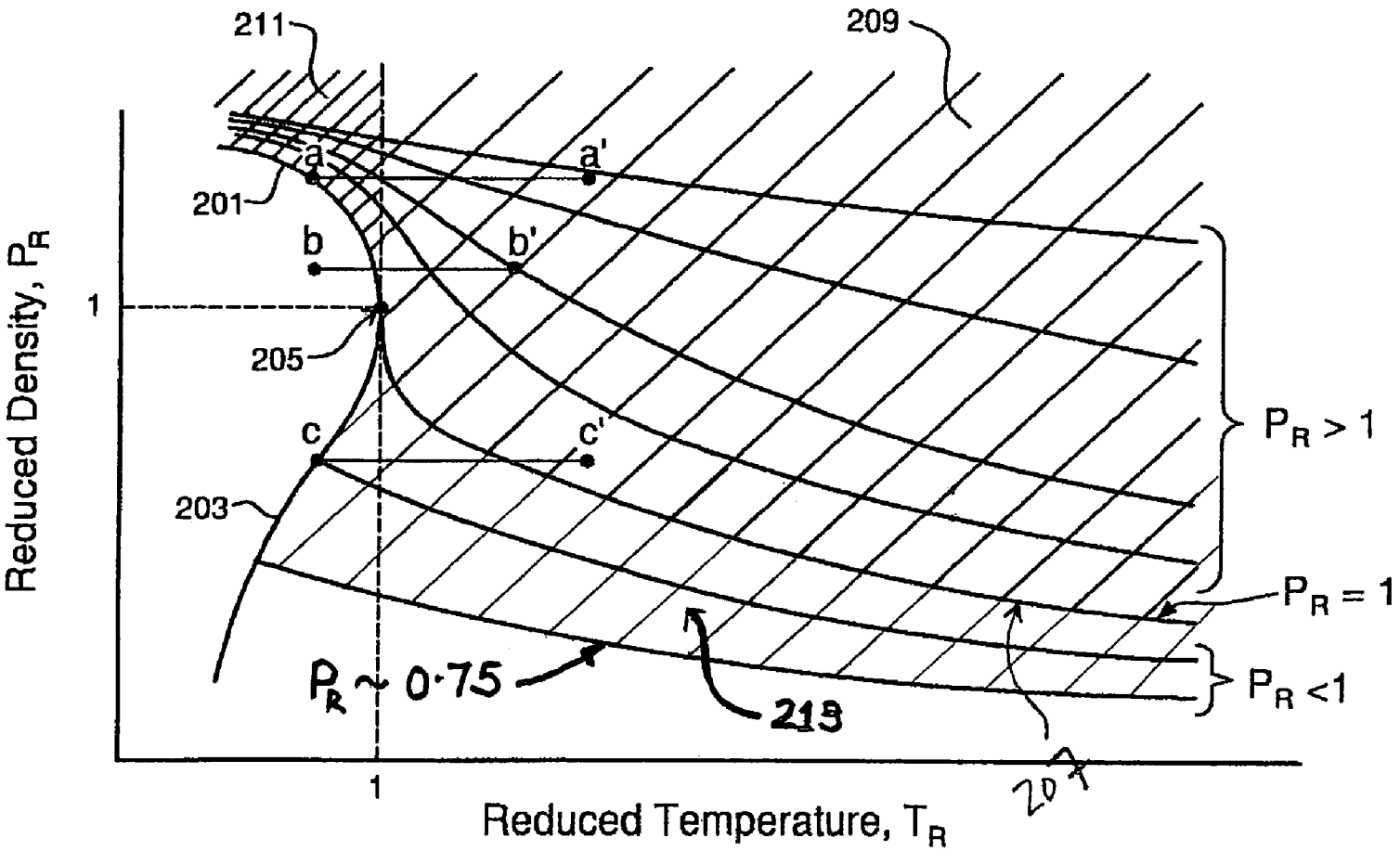
FIG. 3 is a generalized density-temperature phase diagram.

A generic density-temperature diagram can be defined in terms of reduced temperature, reduced pressure, and reduced density as shown in FIG. 3. The reduced temperature ($T_R$) is defined as the absolute temperature divided by the absolute critical temperature, reduced pressure ($P_R$) is defined as the absolute pressure divided by the absolute critical pressure, and reduced density ($\rho_R$) is defined as the density divided by the critical density ($\rho_c$). The reduced temperature, reduced pressure, and reduced density are all equal to 1 at the critical point by definition. FIG. 3 shows analogous features to FIG. 2, including saturated liquid curve 201 and saturated vapor curve 203, which merge at the critical point 205 at a reduced temperature of 1, a reduced density of 1, and a reduced pressure of 1. Lines of constant pressure (isobars) are shown, including critical isobar 207 for which $P_R$=1. In FIG. 3, the region to the left of and enclosed by saturated liquid curve 201 and saturated vapor curve 203 is the two-phase vapor-liquid region. The crosshatched region 209 above the $P_R$=1 isobar and to the right of the critical temperature $T_R$=1 is a single-phase supercritical fluid region. The crosshatched region 211 above saturated liquid curve 201 and to the left of the critical temperature $T_R$=1 is a single-phase compressed liquid region. The cross-thatched region 213 to the right of saturated vapor curve 203, and below the isobar $P_R$=1 represents a single-phase compressed or dense gas. The dense fluid as defined herein includes the single-phase supercritical fluid region 209, single-phase compressed liquid region 211, and the single-phase dense gas region 213.

A dense fluid alternatively may comprise a mixture of two or more components. A multi-component dense fluid differs from a single-component dense fluid in that the liquid saturation pressure, critical pressure, and critical temperature are functions of composition. In this case, the dense fluid is defined as a single-phase multi-component fluid of a given composition which is above its saturation or bubble point pressure, or which has a combination of pressure and temperature above the mixture critical point. The critical point for a multi-component fluid is defined as the combination of pressure and temperature above, which the fluid of a given composition exists only as a single phase. In the present disclosure, the term "dense fluid" as applied to a multi-component fluid is defined to include both a supercritical fluid and a single-phase fluid that exists at a temperature below its critical temperature and a pressure above its bubble point or saturation pressure. A multi-component dense fluid also can be defined as a single-phase multi-component fluid at a pressure above its critical pressure or a pressure above its bubble point or liquid saturation pressure. A multi-component dense fluid can also be defined as a single-phase or multi-phase multi-component fluid at a pressure P in the range $0.75P_c \leqq P \leqq P_c$, and a temperature above its bubble point or liquid saturation temperature. A multi-component subcritical fluid is defined as a multi-component fluid of a given composition which has a combination of pressure and temperature below the mixture critical point.

The generic definition of a dense fluid thus includes a single component dense fluid as defined above as well as a multi-component dense fluid as defined above. Similarly, a subcritical fluid may be a single-component fluid or a multi-component fluid. In some embodiments, a single-component subcritical fluid or a multi-component subcritical fluid may be a dense fluid.

Depending upon the application, the dense fluid may be either a single-component fluid or a multi-component fluid, and may have a reduced temperature in the range of from about 0.2 to about 2.0, and a reduced pressure equal to or above 0.75. The reduced temperature is defined herein as the absolute temperature of the fluid divided by the absolute critical temperature of the fluid, and the reduced pressure is defined here as the absolute pressure divided by the absolute critical pressure.

When carbon dioxide is used for a single-component dense cleaning fluid, the carbon dioxide may be heated to a temperature between about 86° F. (30.08° C.) and about 500° F. (260° C.) to generate the desired dense fluid pressure in the pressurization vessel. More generally, when using any component or components for the dense fluid, the fluid may be heated to a reduced temperature in the pressurization vessel of up to about 2.0, wherein the reduced temperature is defined as the average absolute temperature of the fluid in the pressurization vessel after heating divided by the absolute critical temperature of the fluid. The critical temperature is defined for a fluid containing any number of components as that temperature above which the fluid always exists as a single fluid phase and below which two phases may form.

While the exemplary process described above uses carbon dioxide as the dense fluid, other dense fluid components may also be used for appropriate applications alone or in admixture. The dense fluid may comprise one or more components selected from the group consisting of carbon dioxide, nitrogen, methane, oxygen, ozone, argon, helium, ammonia, nitrous oxide, hydrocarbons having 2 to 6 carbon atoms, hydrogen fluoride, hydrogen chloride, and sulfur trioxide.

In certain embodiments of the present invention, the dense fluid comprises one or more fluorinated dense fluids, such as, but not limited to, perfluorocarbon compounds (e.g., tetrafluoromethane ($CF_4$), hexafluoroethane ($C_2F_6$), hexafluoropropylene ($C_3F_6$), hexafluorobutadiene ($C_4F_6$), pentafluoroethane, perfluoropropane, pentafluoropropane, and octafluorocyclobutane ($C_4F_8$)), hydrofluorocarbons (e.g., monofluoromethane, difluoromethane ($CH_2F_2$), trifluoromethane ($CHF_3$), trifluoroethane, tetrafluoroethane, methyl fluoride ($CH_3F$), pentafluoroethane ($C_2HF_5$), trifluoroethane ($CF_3CH_3$), difluoroethane ($CHF_2CH_3$), and ethyl fluoride ($C_2H_5F$)), fluorinated nitriles (e.g., perfluoroacetonitrile ($C_2F_3N$) and perfluoropropionitrile ($C_3F_5N$)), fluoroethers (e.g., perfluorodimethylether ($CF_3$—O—$CF_3$), pentafluorodimethyl ether ($CF_3$—O—$CHF_2$), trifluorodimethyl ether ($CF_3$—O—$CH_3$), difluoro-dimethyl ether ($CF_2H$—O—$CH_3$), and perfluoromethyl vinyl ether ($CF_2$═CFO—$CF_3$)), fluoroamines (e.g., perfluoromethylamine ($CF_5N$)), and other fluorinated compounds (e.g., hydrogen fluoride, sulfur hexafluoride, chlorine trifluoride, nitrogen trifluoride ($NF_3$), carbonyl fluoride ($COF_2$), nitrosyl fluoride (FNO), hexafluoropropylene oxide ($C_3F_6O_2$), hexafluorodisiloxane ($Si_2OF_6$), hexafluoro-1,3-dioxolane ($C_3F_6O_2$), hexafluoropropylene oxide ($C_3F_6O$), fluoroxytrifluoromethane ($CF_4O$), bis(difluoroxy)methane ($CF_4O_2$), difluorodioxirane ($CF_2O_2$), and trifluoronitrosylmethane ($CF_3NO$)). Further examples of fluorinated dense fluids include, but are not limited to, zeotropic and azeotropic mixtures of different refrigerants such as 507A 507A (mixture of pentafluoroethane and trifluoroethane) and 410A (mixture of difluoromethane and pentafluoroethane). The normal boiling point temperatures ($T_b$), critical temperatures and pressures of some exemplary fluorinated dense fluids are provided in Table I. In these embodiments, fluorinated dense fluids with a low critical temperature ($T_c$) and critical pressure ($P_c$) are preferable.

TABLE I

Thermodynamic Properties of Select Fluorinated Solvents

| Solvent/Gas | Formula | $T_b$ (° C.) | $T_c$ (° C.) | $P_c$ (bar) |
|---|---|---|---|---|
| Nitrogen trifluoride | $NF_3$ | −129.1 | −39.0 | 45.3 |
| Tetrafluoromethane | $CF_4$ | −127.9 | −45.4 | 37.4 |
| Trifluoromethane | $CHF_3$ | −82.1 | 26.3 | 48.6 |
| Hexafluoroethane | $C_2F_6$ | −78.2 | 20.0 | 30.6 |
| Pentafluoroethane | $C_2HF_5$ | −48.6 | 66.3 | 36.3 |
| Difluoromethane | $CH_2F_2$ | −51.8 | 78.6 | 58.3 |
| Methyl Fluoride | $CH_3F$ | −78.4 | 42.0 | 56.0 |
| Trifluoroethane | $C_2F_3H_3$ | −47.2 | 72.7 | 37.6 |
| Refrigerant 507A | Mixture | −47.0 | 70.7 | 37.1 |
| Perfluoroethylene | $C_2F_4$ | −76.0 | 33.3 | 39.4 |
| Perfluoropropylene | $C_3F_6$ | −29.6 | 86.2 | 29.0 |
| Difluoroethylene | $CF_2$═$CH_2$ | −84.0 | 30.0 | 44.6 |
| Perfluoroacetonitrile | $C_2F_3N$ | −64.5 | 38.0 | 36.2 |

A dense cleaning fluid generally describes a dense fluid to which one or more one or more entrainers or processing agents have been added. A processing agent is defined as an agent such as an entrainer which enhances the cleaning ability of the dense fluid to remove contaminants from a contaminated article or substrate. Further, the processing agent may solubilize and/or disperse the contaminant within the dense cleaning fluid. The dense cleaning fluid typically remains a single phase after a processing agent is added to a dense fluid. Alternatively, the dense cleaning fluid may be an emulsion or suspension containing a second suspended or dispersed phase containing the one or more processing agents. The total concentration of these processing agents in the dense cleaning fluid typically is less than about 50 weight percent or may range from 0.1 to 40 weight percent based upon the weight of the dense cleaning fluid.

Processing agents generally may include cosolvents, surfactants, chelating agents, chemical modifiers, and other additives. Some examples of representative processing agents are acetylenic alcohols and derivatives thereof, acetylenic diols (non-ionic alkoxylated and/or self-emulsifiable acetylenic diol surfactants) and derivatives thereof, alcohols, quaternary amines and di-amines, amides (including aprotic solvents such as dimethyl formamide and dimethyl acetamide), alkyl alkanolamines (such as diethanolethylamine), and chelating agents such as beta-diketones, beta-ketoimines, carboxylic acids, mallic acid and tartaric acid based esters and diesters and derivatives thereof, and tertiary amines, diamines and triamines.

In the present invention, at least one of the processing agents within the dense cleaning fluid is an acetylenic alcohol, an acetylenic diol, or a derivative thereof. The amount of the at least one acetylenic alcohol or acetylenic diol may range from 0.01 to 20 weight percent, or from 1 to 10 weight percent of the dense cleaning fluid. The acetylenic alcohol and acetylenic diols are commercially available from Air Products and Chemicals, Inc. of Allentown, Pa., the assignee of the present invention, under the trade names SURFYNOL® and DYNOL®. Examples of acetylenic alcohols include, for example, 1-hexyne-3-ol ($C_6H_{10}O$), 3,6-dimethyl-1-heptyn-3-ol ($C_9H_{16}O$), 3-methyl-1-pentyn-3-ol ($C_6H_{10}O$), 4-ethyl-1-octyn-3-ol ($C_{10}H_{18}O$), and 3,5-dimethyl-1-hexyn-3-ol ($C_8H_{14}O$ commercially available as SURFYNOL® 61). Examples of acetylenic diols include, for example, 5-decyn-4,7-diol ($C_{10}H_{16}O_2$), 2,5,8,11-tetramethyl-6-dodecyn-5,8-diol ($C_{16}H_{30}O_2$ commercially available as SURFYNOL® 124), 3,6-dimethyl-4-octyn-3,6-diol ($C_{10}H_{18}O_2$ commercially available as SURFYNOL® 82), 5,10-diethyl-7-tetradecyn-6,9-diol ($C_{18}H_{32}O_2$), 2,4,7,9-tetramethyl-5-decyn-4,7-diol ($C_{14}H_{26}O_2$ commercially available as SURFYNOL® 104), ethoxylated 2,4,7,9-tetramethyl-5-decyn-4,7-diol, propoxylated 2,4,7,9-tetramethyl-5-decyn-4,7-diol, butoxylated 2,4,7,9-tetramethyl-5-decyn-4,7-diol, 2,5-dimethyl-3-hexyn-2,5-diol ($C_8H_{14}O_2$ commercially available as DYNOL® 604), ethoxylated 2,5,8,11-tetramethyl-6-dodecyn-5,8-diol, and propoxylated 2,5,8,11-tetramethyl-6-dodecyn-5,8-diol ($C_8H_{14}O$). Acetylenic alcohols or acetylenic diols may be soluble within the dense cleaning fluid at a pressure ranging from 1,000 to 7,000 psig, or 1,200 to 6,000 psig, or 1,500 to 4,500 psig. Acetylenic alcohols or acetylenic diols may be soluble within the dense cleaning fluid at temperatures ranging from 10 to 70° C., or from 20 to 60° C., or from 35 to 50° C.

Acetylenic alcohols or diols may be prepared in a number of ways including the methods described, for example, in U.S. Pat. No. 6,313,182 and EP 1115035A1, which are assigned to the assignee of the present invention and incorporated herein by reference in their entirety. One method for preparing these compounds is through the process of ethynylation, or the reaction of acetylene with carbonyl compounds. Typically, ethynylation uses alkali hydroxide basic catalysts to produce alcohols at lower temperatures and diols (glycols) at higher temperatures.

The general molecular structures of the acetylenic alcohol and diol surfactants are represented by Formula A and Formula B, respectively.

Formula A

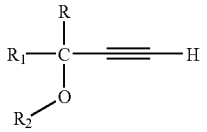

Formula B

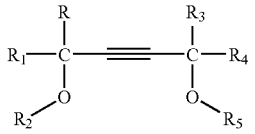

In the above formulas, R, $R_1$, $R_3$, and $R_4$ are each independently hydrogen atoms, a linear alkyl group comprised of from 1 to 34 carbon atoms, or a branched alkyl group comprised of from 2 to 34 carbon atoms; $R_2$ and $R_5$ are each independently a hydrogen atom; a hydroxyl terminated poly-(alkylene oxide) chain derived from 1 to 30 alkylene oxide monomer units, an interactive functional group, and combinations thereof.

Examples of alkylene oxide monomer units include ethylene oxide (EO), propylene oxide (PO), or a unit represented by Formula C, where $R_6$, $R_7$, $R_8$, and $R_9$ are independently hydrogen atoms, a linear alkyl group comprised of from 1 to 5 carbon atoms, a branched alkyl group comprised of from 2 to 5 carbon atoms, or a cyclic alkyl group comprised of from 3 to 5 carbon atoms.

Formula C

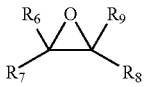

In the formulas described herein, the term "alkyl", unless otherwise specified, includes linear alkyl groups, comprised of from 1 to 34 carbon atoms, or from 1 to 12 carbon atoms, or from 1 to 5 carbon atoms; branched alkyl groups comprised of from 2 to 34 carbon atoms, or from 2 to 12 carbon atoms; or cyclic alkyl groups comprised of from 3 to 34 carbon atoms, or from 3 to 12 carbon atoms. This term applies also to alkyl moieties contained in other groups such as haloalkyl, alkaryl, or aralkyl. The term "alkyl" further applies to alkyl moieties that are substituted. The term "aryl" as used herein six to twelve member carbon rings having aromatic character. The term "aryl" also applies to aryl moieties that are substituted.

The preferred range of alkoxylation, i.e. the weight percent of ethylene oxide, propylene oxide, or unit represented by Formula C, in an acetylenic alcohol or diol ranges from 0.1 to 85% and depends on the application. For example, in dense cleaning fluid applications using $CO_2$ as the dense fluid, the ethoxylation ranges from 0.1 to 60%, or from 0.1 to 40%, or from 0.1 to 20%.

In some embodiments of the present invention, substituent $R_2$ or $R_5$ in Formulas A or B comprises at least one interactive functional group to provide a derivatized acetylenic alcohol or acetylenic diol. The term "interactive functional group" describes a functional group that interacts with at least one of the contaminants contained within the dense cleaning fluid. The interactive functional group is appended to, or in some instances replaces, the hydrogen atom or the alkylene oxide monomer units at substituent $R_2$ or $R_5$.

Derivatized acetylenic alcohols or diols are prepared by reacting reagents having the desired interactive functionality with the acetylenic alcohol or diol, having the Formula A or B, in excess, stoichiometric, or limiting reaction quantities relative to the acetylenic alcohol or acetylenic diol. Stoichiometric or limiting reaction quantities of reagent are preferable to avoid the formation of separate, solid polymeric phases. Reaction conditions such as time, temperature, pressure, atmosphere, etc. may vary based upon the reagent used to provide the interactive functional group. As a result of the reaction, the derivatized acetylenic alcohol or diol has at least one interactive functional group bonded thereto and not as a separate solid polymer phase.

The derivatized acetylenic alcohol or acetylenic diol may obviate the need for adding additional processing agents or processing agents such as, for example, a surfactant or a chelating agent to the dense cleaning fluid. The interactive functional group can be selected to remove a particular contaminant from the substrate. In this regard, dense cleaning fluids can be tailored to selectively remove various contaminants from the substrate such as, for example, inorganics, e.g., metals and metal ions, or organics, e.g., polymeric residues and photoresist.

Formulas D through I provide non-limiting examples of derivatized acetylenic alcohol or acetylenic diol molecules. Exemplary interactive functional groups include amine and acid functionalities (Formula D); ester functionality (Formula E); ether and alcohol functionalities (Formula F); ester and alcohol functionalities (Formula G); nitrile functionalities (Formula H); and carbonate functionalities (Formula I). Still other reagents to provide at least one interactive functional group within the derivatized acetylenic alcohol or diol molecules include alkyl polyglycosides or other sugar derivatives. In formulas D through I, substituent $R_2$ or $R_5$ includes the functional group provided by the reagent and the value of m+n in each formula defines the amount of alkylene oxide monomer units in the initial alcohol or diol molecule to which the interactive functional group is appended thereto. In some embodiments, such as when the value of m+n in the initial alcohol or diol equals zero, the derivatized alcohol or diol contains no alkylene oxide monomer units at $R_2$ and/or $R_5$.

The derivatized acetylenic alcohol or diol may have one or more acid and amine groups as the interactive functional group. Formula D provides an example of a derivatized diol wherein substituent $R_5$ is an acid and amine functional group and the value of m+n is a number ranging from 0 to 30. In these embodiments, the acetylenic diol or acetylenic alcohol may be reacted with at least one reagent such as, for example, ethylenediamine tetraacetate anhydride, to provide a derivatized acetylenic alcohol or diol containing varying amounts of an acid and amine functionality.

Formula D

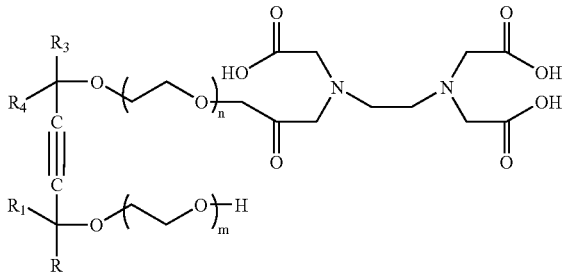

In an alternative embodiment, the amount of acetylenic alcohol and/or acetylenic diol may be present in relatively higher concentrations than the reagent used to provide the interactive functional group during the reaction. In these embodiments, only a portion of the acetylenic alcohol or diol is derivatized. For example, an excess of the acetylenic alcohol or acetylenic diol may be reacted with the ethylenediamine tetraacetate anhydride reagent to provide a molecule comprising 2 acetylenic alcohol or acetylenic diol molecules associated with one ethylenediamine tetracetate anhydride. By contrast, the compound in Formula D comprises 1 ethylenediamine tetraacetate anhydride molecule associated with one acetylenic alcohol or diol molecule.

The derivatized acetylenic alcohol or diol may have one or more ester functionalities as the interactive functional group. In these embodiments, the acetylenic diol or acetylenic alcohol may be reacted with at least one reagent such as, for example, acetyl chloride to provide a derivatized acetylenic alcohol or diol containing varying amounts of an ester functionality. Formula E provides an example of a derivatized diol wherein substituent $R_5$ is an ester functional group, the value of m+n is a number ranging from 0 to 30, and the value of s+t is a number ranging from 1 to 2.

Formula E

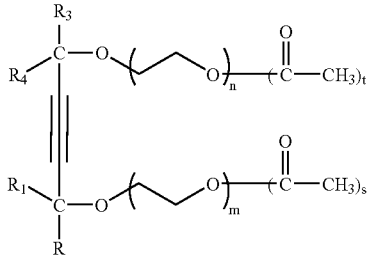

The derivatized acetylenic alcohol or diol may have one or more ether and alcohol functionalities as the interactive functional group. In these embodiments, the acetylenic diol or acetylenic alcohol may be reacted with at least one reagent such as, for example, glycidyl methylether, glycidyl isopropylether, glycidyl butylether, glycidyl tetrafluoroethylether or other glycidyl alkylethers or glycidyl fluoroalkylethers, to provide a derivatized acetylenic alcohol or diol containing varying amounts of combined ether and alcohol functionalities. Formula F provides an example of a derivatized diol wherein substituent $R_5$ is an ether and alcohol functional group, the value of m+n is a number ranging from 0 to 30, and the value of s+t is a number ranging from 1 to 2, and $R_{10}$ and $R_{11}$ are each independently a linear alkyl or fluoroalkyl group comprised of from 1 to 34 carbon atoms; a branched alkyl or fluoroalkyl group comprised of from 2 to 34 carbon atoms; or a cyclic alkyl or fluoroalkyl group comprised of from 3 to 34 carbon atoms.

Formula F

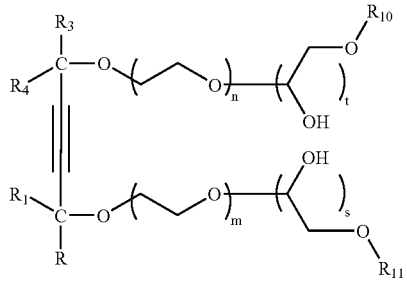

The derivatized acetylenic alcohol or diol may have one or more ester and alcohol functionalities as the interactive functional group. In these embodiments, the acetylenic diol or acetylenic alcohol may be reacted with at least one reagent such as, for example, glycidyl acetate, glycidyl butyrate, glycidyl benzoate, glycidyl methacrylate or other glycidyl esters to provide a derivatized acetylenic alcohol or diol containing varying amounts of a combined ester and alcohol functionalities. The glycidyl reagent may also be a glycidyl nitrobenzoate, a glycidyl carboxamide, a glycidyl tosylate or a glycidoxypropyldimethylethoxysilane to provide other desired chelating or solubilizing functionalities. Formula G provides an example of a derivatized diol wherein substituent $R_5$ is an ester and alcohol functional group, the value of m+n is a number ranging from 0 to 30, the value of s+t is a number ranging from 1 to 2, and $R_{12}$ and $R_{13}$ are each independently a linear alkyl or fluoroalkyl group comprised of from 1 to 34 carbon atoms; a branched alkyl or fluoroalkyl group comprised of from 2 to 34 carbon atoms; or a cyclic alkyl or fluoroalkyl group comprised of from 3 to 34 carbon atoms.

Formula G

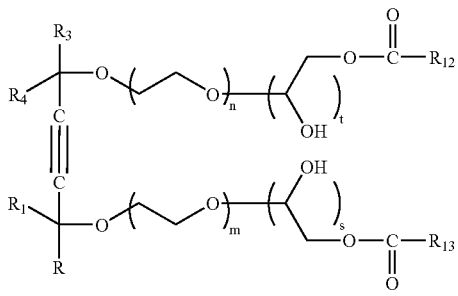

The derivatized acetylenic alcohol or diol may have one or more nitrile functionalities as the interactive functional group. In these embodiments, the acetylenic diol or acetylenic alcohol may be reacted with at least one reagent such as, for example, acrylonitrile or other nitrile monomer to provide a nitrile end-capped derivatized acetylenic alcohol or diol containing varying amounts of nitrile functionality. Formula H provides an example of a derivatized diol wherein substituent $R_5$ is a nitrile functional group, the value of m+n is a number ranging from 0 to 30, and the value of s+t is a number ranging from 1 to 2.

Formula H

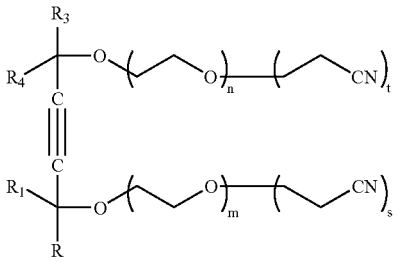

The derivatized acetylenic alcohol or diol may have one or more carbonate functionalities as the interactive functional group. In these embodiments, the acetylenic diol or acetylenic alcohol may be reacted with at least one reagent such as, for example, an alkylene carbonate to provide an alkyl carbonate end-capped acetylenic alcohol or diol containing varying amounts of carbonate functionality. Formula I provides an example of a derivatized diol wherein substituent $R_5$ is a nitrile functional group, $R_{14}$ and $R_{15}$ are each independently a linear, branched, or cyclic alkyl group comprised of from 1 to 34 carbon atoms, the value of m+n is a number ranging from 0 to 30, and the value of s+t is a number ranging from 1 to 2.

Formula I

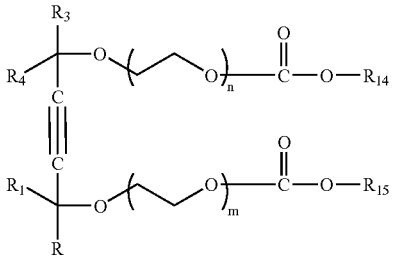

As mentioned previously, further processing agents that may be added to the dense cleaning fluid include, but are not limited to, cosolvents, surfactants, chelating agents, chemical modifiers, or other additives. The total concentration of these additional processing agents in the dense cleaning fluid typically is less than about 50 weight percent, or may range from about 0.1 to about 40 weight percent.

In embodiments wherein a cosolvent is added to the dense cleaning fluid, the cosolvent is preferably at least one cosolvent selected from the group consisting of esters (ethyl acetate, ethyl lactate), ethers (diethyl ether, dipropyl ether), alcohols (methanol, isopropanol), nitriles (acetonitrile, propionitrile, benzonitrile), hydrated nitriles (ethylene cyanohydrin), glycols (ethylene glycol, propylene glycol), monoester glycols (ethylene glycol monoacetate), ketones (acetone, acetophenone) and fluorinated ketones (trifluoroacetophenone), tertiary amines including pyridines (triethyl amine, tributyl amine, 2,4, dimethyl pyridine), alkanolamines (dimethylethanolamine, diethylethanolamine), amides (dimethylformamide, dimethylacetamide), carbonates (ethylene carbonate, propylene carbonate), carboxylic acids (acetic acid, tartaric acid, malic acid), alkane diols (butane diol, propane diol), alkanes (n-hexane, n-butane), peroxides (hydrogen peroxide, t-butyl hydroperoxide, 2-hydroperoxy hexafluoropropan-2-ol), water (deionized, ultra-high purity), ureas, haloalkanes (perfluorobutane, hexafluoropentane), haloalkenes, and combinations thereof. The amount of cosolvent added to the dense fluid may range from 1 to 40 weight percent, or from 1 to 20 weight percent, or from 1 to 10 weight percent. In certain embodiments, the cosolvent is a nitrile compound, such as benzonitrile, propionitrile, or acetonitrile, which is present in the dense cleaning fluid in an amount ranging from 1 to 20 weight percent, or from 1 to 10 weight percent.

Chelating agents may also be added to the dense cleaning fluid in an amount ranging from 0.01 to 20 weight percent, or from 1 to 5 weight percent. Examples of suitable chelating agents include, but are not limited to a beta-diketones such as acetylacetone, acetonyl acetone, trifluoroacetylacetone, thenoyltrifluoroacetone, or hexafluoroacetylacetone, a carboxylic acid such as citric acid, malic acid, oxalic acid, or tartaric acid, a malic acid ester and/or diester, a tartaric acid ester and/or diester, an oxine such as 8-hydroxyquinoline, a tertiary amine such as 2-acetyl pyridine, a tertiary diamine, a tertiary triamine, a nitrile such as ethylene cyanohydrin, a beta-ketoimine, ethylenediamine tetraacetic acid and its derivatives, catechol, choline-containing compounds, trifluoroacetic anhydride, an oxime such as dimethyl glyoxime, dithiocarbamates such as bis(trifluoromethyl)dithiocarbamate, terpyridine, ethylene cyanohydrin, N-(2-hydroxyethyl)iminodiacetic acid, and combinations thereof.

In one embodiment of the present invention, one or more processing agents (chelating agents and/or surfactants) within the dense cleaning fluid may be a malic acid diester, a tartaric acid diester, or derivatives thereof. In these embodiments, the amount of the malic acid diester processing agent or the tartaric acid diester processing agent within the dense cleaning fluid may range from 0.01 to 20 weight percent, or from 1 to 10 weight percent. The malic acid diester and tartaric acid diester are very soluble in dense $CO_2$ fluids and are effective processing agents for removing photoresist and photoresist residue. These molecules and their methods of preparation have been described, for example, in U.S. Pat. No. 6,423,376B1, U.S. Pat. No. 6,369,146B1, and U.S. Pat. No. 6,544,591B2, which are assigned to the assignee of the present invention and incorporated herein by reference in their entirety.

Exemplary malic acid diesters and tartaric acid diesters are represented by the following Formula J and K:

Structure J

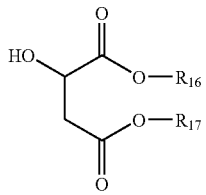

Structure K

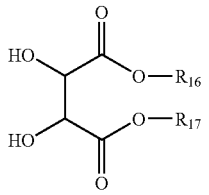

where $R_{16}$ and $R_{17}$ are independently a linear or haloalkyl group comprised of from 1 to 20 carbon atoms; a branched alkyl or haloalkyl group comprised of from 2 to 20 carbon atoms; or a cyclic alkyl or haloalkyl group comprised of from 3 to 20 carbon atoms. Substituents $R_{16}$ and $R_{17}$ may be the same or different; however, symmetrical malates or tartrates, i.e., where $R_{16}$ and $R_{17}$ are identical, may be preferred due to ease of synthesis. Stereo isomers of the malic acid diesters or tartaric acid diesters are also suitable for the present invention. Suitable alkyl groups for the diesters, also known as dialkylmalates and dialkyltartrates, include, for example, methyl, ethyl, n-propyl, isopropyl, n-butyl, isobutyl, sec-butyl, n-pentyl, 3-methyl-2-butyl, cyclopentyl, cyclohexyl, 2-ethylhexyl, and dodecyl groups. The alkyl groups may further include one or more halogen atoms such as haloalkyl groups, preferably fluoroalkyl groups. Malic acid diesters and tartaric acid diesters are soluble within the dense cleaning fluid at pressures ranging from 1,000 to 7,000 psig, or from 1,200 to 6,000 psig, or from 21,500 to 4,500 psig. They are soluble at temperatures ranging from 10 to 70° C., or from 20 to 60° C., or from 35 to 50° C.

In other embodiments of the present invention, the malic acid diester or tartaric acid diester may be reacted with a reagent containing at least one interactive functional group to provide a derivatized malic acid diester or a derivatized tartaric acid diester. In these embodiments, reagents having the desired functionality are reacted with the diester in excess, stoichiometric, or limiting reaction quantities relative to the diester. Stoichiometric or limiting reaction quantities of reagent may be used to avoid the formation of separate, solid polymeric phases. Reaction conditions such as time, temperature, pressure, atmosphere, etc., may vary based upon the reagent used to provide the functional group. As a result of the reaction, the diester has an interactive functional group bonded thereto and not as a separate solid polymer phase. Like the derivatized acetylenic alcohol or derivatized acetylenic diol, the derivatized diesters may obviate the need for adding separate processing agents such as a surfactant and a chelating agent to the dense cleaning fluid. Further, one or more interactive functional groups on the diester may be selected to remove a particular contaminant from the article or substrate.

Exemplary derivatized malic acid diesters and tartaric acid diesters are represented by the following Formula L and M:

Formula L

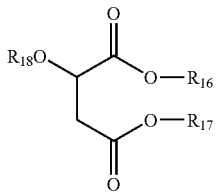

Formula M

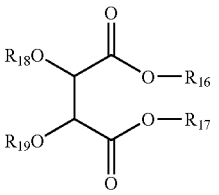

In the preceding formula, substituent $R_{18}$ and $R_{19}$ are one or more interactive functional groups provided by the reagent. Exemplary interactive functional groups $R_{18}$ and $R_{19}$ include, but are not limited to, acids, amines, acetates, amino acetates, glycidyl ethers or esters, carbonates, tertiary amines, beta-diketones, beta-ketoimines, alkenes, and nitriles. In one embodiment, the malic acid diester or tartaric acid diester may be reacted with ethylenediamine tetraacetate anhydride to provide a derivatized malic acid diester or derivatized tartaric acid diester containing varying amounts of an amine and acid functionality. In other embodiments, the malic acid diester or tartaric acid diester may be reacted with acetyl chloride to provide a derivatized malic acid diester or derivatized tartaric acid diester containing varying amounts of an ester functionality; reacted with glycidyl methylether, glycidyl isopropylether, glycidyl butylether, glycidyl tetrafluoroethylether or other glycidyl alkylethers or glycidyl fluoroalkylethers to provide a derivatized malic acid diester or tartaric acid diester containing varying amounts of combined ether and alcohol functionalities; reacted with glycidyl acetate, glycidyl butyrate, glycidyl benzoate, glycidyl methacrylate, or other glycidyl esters to provide a derivatized malic acid diester or tartaric acid diester containing varying amounts of a combined ester and alcohol functionalities. The glycidyl reagent may also be a glycidyl nitrobenzoate, a glycidyl carboxamide, a glycidyl tosylate, or glycidoxypropyldimethylethoxysilane to provide other desired chelating or solubility functionalities. In other embodiments, the malic acid diester or tartaric acid diester may be reacted with acrylonitrile or other nitrile monomers to provide a nitrile end-capped derivatized malic acid diester or derivatized tartaric acid diester containing varying amounts of nitrile functionality. In yet another embodiment, the malic acid diester or tartaric acid diester may be reacted with an alkylene carbonate to provide an alkyl carbonate end-capped malic acid diester or tartaric acid diester containing varying amounts of carbonate functionality.

In formulations wherein a cosolvent and a chelating agent is added to the dense cleaning fluid, the composition of the dense cleaning fluid comprises from 50 to 99 weight percent of dense fluid, from 1 to 20 weight present of a cosolvent, from 1 to 10 weight percent of at least one acetylenic diol or acetylenic alcohol, and from 0.1 to 10 weight percent of a chelating agent. In one particular embodiment, the dense cleaning fluid comprises from 65 to 99 weight percent of a dense fluid such as liquid/supercriticial $CO_2$, from 1 to 20 weight percent of a co-solvent such as a nitrile compound, from 1 to 10 weight percent at least one acetylenic alcohol or acetylenic diol, and from 0.1 to 5 weight percent of a chelating agent. In another embodiment the dense cleaning fluid comprises from 0.1 to 99 wt % of a dense fluid such as liquid/supercritical $CO_2$, from 5 to 90.0 wt % of a fluorinated dense fluid (e.g. supercritical hexafluoroethane), from 0 to 10 wt % of at least one acetylenic alcohol and/or acetylenic diol, from 0 to 20 wt % of a co-solvent, and from 0 to 5 wt % of a chelating agent. In yet another embodiment, the dense cleaning fluid comprises from 0.1 to 95 weight percent of a dense fluid such as liquid/supercriticial $CO_2$, from 5 to 99.9 weight percent of a fluorinated dense fluid, from 0 to 40 weight percent of a co-solvent such as a nitrile compound, and from 0 to 40 of at least one processing agent.

The specific composition of the dense cleaning fluid depends on the application. Exemplary formulations for various substrate treatment applications are provided in Table II.

TABLE II

Exemplary Formulations for Various Substrate Treatment Applications

| Application | Exemplary Residues or Contaminants | Dense Fluid | Acetylenic Alcohol or Acetylenic Diol | Cosolvent | Chelating Agent |
|---|---|---|---|---|---|
| Post-etch cleaning (metals) | Fluoropolymers, organometallic species, metal particles | Liquid or Supercritical $CO_2$ Supercritical $C_2F_6$ | Surfynol ® 61, Surfynol ® 420, Dynol ® 604 Hydrogenated Surfynol ® 104 | Tertiary ammonium hydroxides(TMAH, TBAH), Alkanolamines, Nitriles | Dibutyl malate Dipentyl tartrate Diisoamyl tartrate |
| Post-etch cleaning (polymers) | Fluoropolymers, hardened organic polymer | Liquid or Supercritical $CO_2$, Supercritical $C_2F_6$ | Surfynol ® 61, Surfynol ® 420, Dynol ® 604, Hydrogenated Surfynol ® 104 | TMAH, TBAH, Alkanolamines, Nitriles, Tertiary amines | |
| Post-CMP cleaning | Metal particles and ions, organic and inorganic solvent residues | Liquid or Supercritical $CO_2$ | Surfynol ® 61, Surfynol ® 2502 Surfynol ® 420 Hydrogenated Surfynol ® 104 | TMAH, TBAH, Alkanolamines, Tertiary amines | Dibutyl malate, Dipentyl tartrate, Diisoamyl tartrate, Carboxylic acids |
| Photoresist removal/ stripping | Organic polymer residue, fluoropolymers | Liquid or Supercritical $CO_2$ | Surfynol ® 61, Surfynol ® 420, Dynol ® 604, Hydrogenated Surfynol ® 104 | Nitriles, Tertiary amines, Acetophenone, Alkanolamines | |
| Ash residue removal | Oxidized carbon residue, organic polymer or fluoropolymer residue, oxidized metallic residue | Liquid or Supercritical $CO_2$ | Surfynol ® 61, Surfynol ® 420, Dynol ® 604, Hydrogenated Surfynol ® 104 | Alkanolamines, Tertiary amines, Nitriles | Dibutyl malate, Dipentyl tartrate, Diisoamyl tartrate, Carboxylic acids |

In one embodiment of the present invention, the dense cleaning fluid may be made using the method and/or apparatus provided in U.S. patent application Ser. No. 10/253,296 which was filed on Sep. 24, 2002. In this embodiment, additives such as at least one processing agent and/or cosolvent, may be added to the dense fluid, which optionally contains at least one fluorinated dense fluid, either before, during, and/or after transferring the dense fluid from the pressurization vessel to the processing chamber. Alternatively, additives such as at least one processing agent and/or cosolvent, may be added to the subcritical fluid, which optionally contains at least one fluorinated dense fluid, in the pressurization vessel before, during, and/or after heating the pressurization vessel to transform the subcritical fluid to the dense fluid.

The substrate containing the contaminants may be contacted with the dense cleaning fluid using a variety of different apparatus and operating conditions. The actual conditions of the contacting step (i.e., temperature, pressure, contact time, and the like) may vary over wide ranges and are generally dependent on a variety of factors such as, but not limited to, the nature and amount of residue on the surface of the substrate, the solubility of the one or more processing agents in the dense fluid, the phobicity or philicity of the contaminant(s) within the dense cleaning fluid, etc. The duration of the contacting step, or time of contact of the dense cleaning fluid with the substrate surface, can vary from a fraction of a second to hundreds of seconds. Preferably, the duration can range from 0.1 to 600 seconds, or from 1 to 300 seconds, or from 15 to 240 seconds.

The dense cleaning fluid can be contacted with the substrate using either a dynamic method, a static method, or combinations thereof. In the dynamic method, a dense cleaning fluid is applied to the article or substrate by flowing or spraying the fluid, such as for example, by adjusting inlet flow and pressure, to maintain the necessary contact time. Alternatively, the contact step may be conducted using a static method such as for example, immersing the substrate within a chamber containing the dense cleaning fluid or applying the dense cleaning fluid to the article or substrate and allowing it to contact the dense cleaning fluid for a certain period of time.

In some embodiments, the dense fluid can be applied to the surface of the substrate after the introduction of the processing agent (acetylenic alcohol and/or acetylenic diol) and optional additives, by first treating the substrate with the processing agent and optional additives and then placing the substrate in contact with the dense fluid to provide the dense cleaning fluid. Alternatively, the dense fluid and the acetylenic alcohol and/or acetylenic diol and optional additives may be introduced into the vessel sequentially, such as, for example, by first introducing the dense fluid and subsequently introducing the processing agent (acetylenic alcohol and/or acetylenic diol) and optional additives. In this case, the dense cleaning fluid may be formed in multiple steps during the processing of the substrate. In still further embodiments of the present invention, the processing agent can be deposited upon or comprise the material of a high surface area device such as a cartridge or filter (which may or may not include other additives). A stream of dense fluid then passes through the cartridge or filter thereby forming the dense cleaning fluid. In still another embodiment of the present invention, the dense cleaning fluid is prepared during the contacting step. In this connection, at least one processing agent is introduced via a dropper or other means to the surface of the substrate. The dense fluid medium is then introduced to the surface of the article which mixes with the at least one processing agent on the surface of the article thereby forming the dense cleaning fluid. Other alternatives include immersing the article in a pressurized, enclosed chamber and then introducing the appropriate quantity of processing agent.

Typically, the contacting step may be performed by placing a substrate having contaminants within a high pressure chamber and heating the chamber to the desired temperature. The substrate may be placed vertically, at an incline, or preferably in a horizontal plane. The dense cleaning fluid can be prepared prior to its contact with the substrate surface. For example, a certain quantity of one or more processing agents (acetylenic alcohols and/or acetylenic diols) can be injected into a continuous stream of the dense fluid medium that optionally includes other processing agents and/or additives thereby forming the dense cleaning fluid. The dense cleaning fluid can also be introduced into the heated chamber before or after the chamber has been pressurized to the desired operating pressure.

In one particular embodiment, the desired pressure can be obtained by introducing dense fluid into an enclosed chamber. In this embodiment, additional processing agents (e.g., co-solvents, chelating agents, and the like) may be added at an appropriate time prior to and/or during the contacting step. The processing agent, or a mixture thereof, forms the dense cleaning fluid after the processing agent and dense fluid have been combined. The dense cleaning fluid then contacts the substrate and the contaminant associates with the processing agent and/or mixture thereof, and becomes entrained in the fluid. Depending on the conditions employed in the separation process, varying portions of the contaminant may be removed from the substrate, ranging from relatively small amounts to nearly all of the contaminant.

During the contacting step, the chamber temperature can range from 10 to 100° C., or from 20 to 70° C., or from 25 to 60° C. The operating pressure can range from 1000 psig to 8000 psig (69 to 552 bar), or from 2000 psig to 6000 psig (138 to 414 bar), or from 2500 to 4500 psig (172 to 310 bar). Optional agitation methods such as ultrasonic energy, mechanical agitation, gas or liquid jet agitation, pressure pulsing, or any other suitable mixing technique may be used to enhance cleaning efficiency and contaminant removal. In one embodiment, the substrate is contacted with the dense cleaning fluid while applying ultrasonic energy during at least a portion of the contacting step. In this embodiment, the ultrasonic energy may be applied using the method and/or apparatus disclosed, for example, in pending U.S. patent application Ser. No. 10/253,054, filed 24 Sep. 2002 which is incorporated herein by reference in its entirety.

Figure 4:
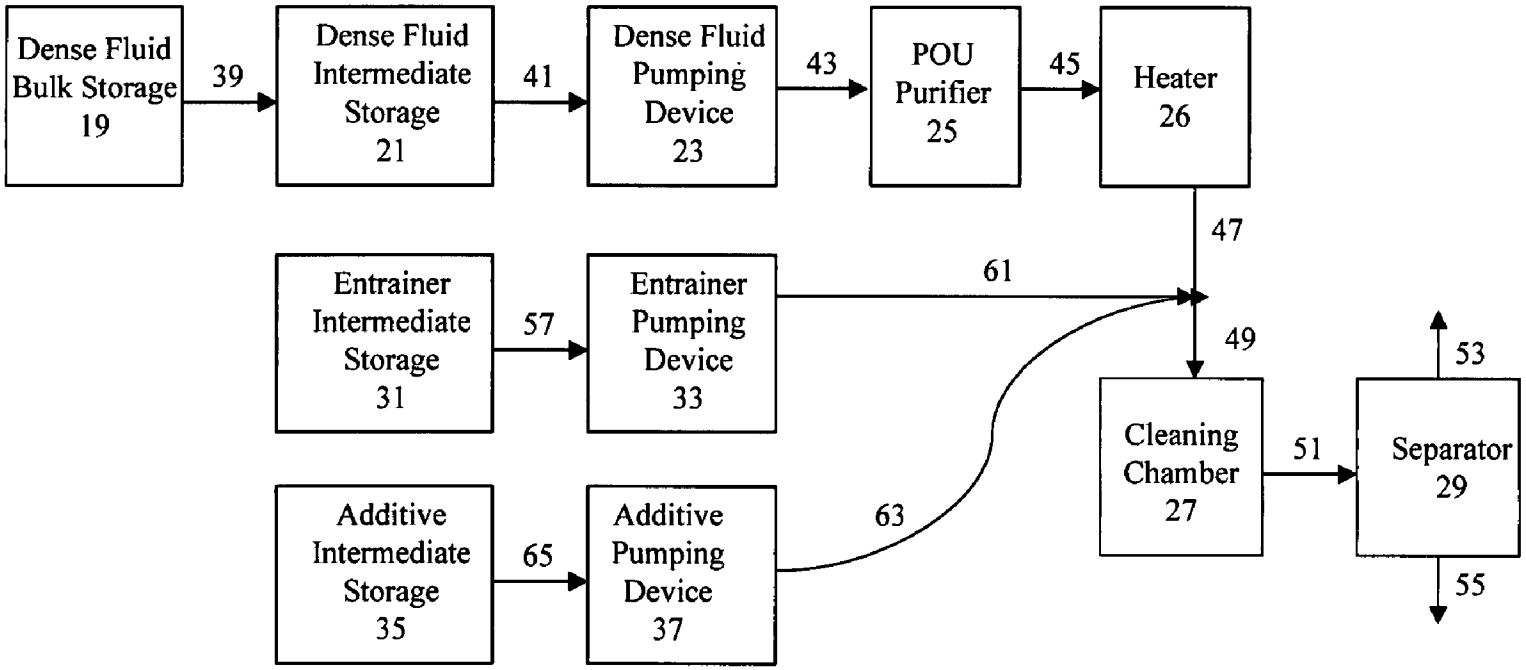
FIG. 4 is a process flow diagram illustrating an embodiment of the invention.

An embodiment of the invention can be illustrated by the delivery and use of a dense processing fluid for use in the cleaning or processing of a substrate such as a microelectronic component. An exemplary process for this embodiment is provided in FIG. 4. FIG. 4 illustrates a system in which dense cleaning fluid is contacted with the processing agent (at least one acetylenic alcohol or acetylenic diol), and optionally other processing agents or additives, prior to being introduced to cleaning chamber 27. A dense fluid stream 39 from a bulk fluid source 19 is supplied to an intermediate storage device 21 such as a tank or a Y container. The dense fluid may be stored as a dense gas, a liquid or a supercritical fluid, or preferably as a liquid at ambient temperature. Pumping device 23 helps increase the pressure of the dense fluid stream 41 from the intermediate storage device 21 prior to its entry into heating device 26. Pumping device 23 can be a pump, a compressor, or any other device capable of increasing pressure at a set flow rate. Preferably, pumping device 23 is a diaphragm pump. High pressure fluid stream 43 is brought to processing temperature by heating device 26 prior to being contacted with the acetylenic alcohol and/or acetylenic diol processing agent or entrainer and any optional processing agents and/or additives.

The acetylenic alcohol and/or acetylenic diol processing agent or entrainer stream 57 is supplied from an processing agent or entrainer intermediate storage device 31 and is pumped to the desired operating pressure by the processing agent or entrainer pumping device 33. The optional additive stream 65 is supplied from an additive intermediate storage device 35 and is pumped to the desired operating pressure by the additive pumping device 37. The contents of the high pressure processing agent and additive streams, 61 and 63 respectively, are then intimately contacted with the heated dense fluid stream 47 to create a dense fluid cleaning stream 49. Alternatively, pressurized streams 61 and 63 can be contacted with the dense fluid stream 43 prior to heating with heater 26. The advantage of this alternative embodiment is that all streams are heated evenly prior to introduction into the cleaning chamber 27. In a still further embodiment, the additives can be premixed with the at least one acetylenic alcohol and/or diol processing agent prior to pressurization and delivery, thereby obviating the need for the additive intermediate storage device and the additive pumping device.

Cleaning chamber 27 is subsequently purged (rinsed) with purified dense fluid to ensure that the contaminants are separated from the article or substrate and to prevent redeposition of the contaminants. The rinse also ensures removal of any processing agent and additive from the process chamber. Subsequently, the contaminant is separated from the dense fluid. Any known technique may be employed for this step. In one embodiment, temperature and pressure profiling of the fluid is employed to vary the solubility of the contaminant in the dense fluid such that it separates out of the fluid. In addition, the same technique may be used to separate the processing agent from the dense fluid. Additionally, a co-solvent, co-surfactant, or any other additive material can be separated. In the embodiment depicted in FIG. 4, separator 29 is used to separate the dense fluid stream 53 from the processing agent or entrainer and optional additive stream 55.

Any of the elements containing within the dense cleaning fluid may be recycled for subsequent use in accordance with known methods. For example, in one embodiment, the temperature and pressure of the vessel may be varied to facilitate removal of residual processing agent and/or additives from the article or substrate being cleaned. In an alternative embodiment, one or more components of the dense fluid such as, for example, the perfluorinated and fluorochemical dense fluid, may be separated and recovered using the methods and apparatuses disclosed in U.S. Pat. Nos. 5,730,779; 5,976,222; 6,032,484; and 6,383,257 which are assigned to the assignee of the present invention and incorporated herein by reference in their entirety.

Dense cleaning fluids prepared and managed by the methods of the present invention may be used in other processing steps in the manufacture of electronic components in which material is removed from a part (etching, drying, or planarization), in which material is deposited on a part (thin film deposition), or in which material on a part is chemically modified (photoresist development). Still further non-limiting applications of the dense cleaning fluid and method contain herein may be removal of a variety of contaminants from an article or substrate.

In applying the present invention, articles such as semiconductor substrates may be cleaned or processed individually in order to provide direct process integration with other, single substrate processing modules. Alternatively, multiple substrates, or batches, may be cleaned or processed simultaneously in a container or "boat" placed within the cleaning or processing chamber, thereby providing high throughput and reduced cost of operation.

The following Examples illustrate embodiments of the present invention but do not limit the embodiments to any of the specific details described therein.

EXAMPLES

Examples 1 Through 12a

Solubility of Processing Agents within a Dense Fluid

In the following examples, mixtures of processing agents such as acetylenic alcohols, acetylenic diols, co-solvents, and chelating agents with liquid/supercritical $CO_2$ as the dense fluid were prepared by adding the one or more processing agents to a stainless steel variable volume high-pressure view cell equipped with suitable pressure relief devices, high-pressure inlet and outlet valves, a magnetic stirrer for agitating the mixture, pressure transducer, an internal thermocouple, and a sapphire window at one end. The cell is mounted horizontally and equipped with a heating/cooling jacket through which a cooling/heating fluid is circulated. A circulating bath was used to supply and pump the cooling/heating fluid to ensure isothermal (constant temperature) operation. The pressure in the cell was adjusted by changing the position of a piston. The moving piston was viewed through the sapphire window using a suitable optic device and the image was transmitted to a video screen. A description of the vessel is given in the Journal of Physical Chemistry 94 (1990), pp 6021 which is incorporated herein by reference in its entirety.

A high-pressure syringe pump (High Pressure Products HIP pump) was filled with liquid $CO_2$ and used to add $CO_2$ to the pressure vessel. A weighed amount of surfactant or co-solvent, ranging from 1 to 30 weight percent, was charged inside the chamber of the cell in front of the piston. The identity and amount of each reagent within the mixture is provided in Table III. The cell window was attached and approximately 10 to 15 cc of $CO_2$ was added to the chamber of the cell while maintaining the cell temperature at a relatively constant value (24–26° C.) to provide a mixture. After the chamber of the cell had been charged with the appropriate amount of $CO_2$, the cooling bath temperature was adjusted to maintain the desired cell temperature (35–60° C.). After the cell had attained thermal equilibrium, the pressure within the cell chamber was gradually increased in increments of 5 bar. The cell was monitored through the sapphire window until the cloud point of the mixture, or the point where the image within the sapphire window changes from being translucent to clear/transparent and vice-versa, was observed. The pressure and temperature at which the cloud point occurred was noted as being indicative of solubility of the mixture and is provided in Table III. The onset of solubility/insolubility was verified by varying the pressure, i.e., cycling the pressure above and below its cloud point value.

The results in Table III illustrate that certain processing agents, i.e., acetylenic alcohols, acetylenic diols, nitriles, and alkyl diesters such as dibutyl malate, are soluble in liquid and supercritical $CO_2$. The supercritical $CO_2$ results ($CO_2$ is in the supercritical phase at temperatures above 31° C. and pressures above 73 bar) indicate that several acetylenic alcohols and acetylenic diols including Surfynol®61, Surfynol®420, Hydrogenated Surfynol®104, and Dynol®604, and alkyl diesters such as dibutyl malate, can be dissolved in relatively larger quantities, e.g., 5–10 wt %, in supercritical $CO_2$ at moderate pressure and temperature conditions, e.g., pressures below 200 bar or approximately 3000 psig. The solubility of acetylenic alcohols and acetylenic diols in supercritical $CO_2$ is as good as, or better than, well known but more expensive $CO_2$-soluble species like fluoracrylates and polydimethylsiloxane at the same temperature and pressure conditions. For example, at a fixed composition (5 wt %) and temperature (35° C.), a silicone-based processing agent, such as example 12a, is soluble only at pressures above 172.5 bar, whereas in examples 1c and 2c processing agents Surfynol®61 and Surfynol®420 are soluble at pressures above 137.5 bar and 150.0 bar, respectively. Further, the high solubility of Surfynol®61 and Hydrogenated Surfynol®104 at low pressures makes them particularly useful as a part of any cost-effective dense fluid $CO_2$-based cleaning or substrat treatment formulation.

The results for liquid $CO_2$ at ambient temperature (approximately 25° C.) indicate that all the nitriles (benzonitrile, propionitrile, acetonitrile) are miscible in liquid $CO_2$ or dissolve upon agitation. The results also indicate that nitriles (benzonitrile, acetonitrile and propionitrile) are soluble at a concentration of up to 20 wt % in supercritical $CO_2$ at pressures below 140 bar, or approximately 2050 psig. Thus, they can be efficiently used individually, or as co-solvents in conjunction with acetylenic alcohols and acetylenic diols, to remove contaminants at pressures below 3000 psig and temperatures up to 60° C., because they may help increase the solubility and miscibility of the acetylenic alcohols and diols in dense fluid $CO_2$

TABLE III

Liquid and Supercritical Solubility of Various Processing Agents

| Example Number | Processing agents | Wt % of Processing agent | Temp. (° C.) | Average Pressure (bar) | Comments |
|---|---|---|---|---|---|
| Ex. 1a | Surfynol ® 61 | 10 | 35 | 137.5 | Soluble at > 10 wt % |
| Ex. 1b | Surfynol ® 61 | 10 | 50 | 106.0 | Soluble at > 10 wt % |
| Ex. 1c | Surfynol ® 61 | 5 | 35 | 137.5 | |
| Ex. 2a | Surfynol ® 420 | 10 | 35 | 139.5 | |
| Ex. 2b | Surfynol ® 420 | 10 | 50 | 187.5 | |
| Ex. 2c | Surfynol ® 420 | 5 | 35 | 150.0 | |

TABLE III-continued

Liquid and Supercritical Solubility of Various Processing Agents

| Example Number | Processing agents | Wt % of Processing agent | Temp. (° C.) | Average Pressure (bar) | Comments |
|---|---|---|---|---|---|
| Ex. 2d | Surfynol ® 420 | 5 | 50 | 190.0 | |
| Ex. 3a | Diethylethanolamine | 5.35 | 37–38 | 147.5 | |
| Ex. 3b | Diethylethanolamine | 6.19 | 41–42 | 160.0 | |
| Ex. 4a | Hydrogenated Surfynol ® 104 | 10 | 35 | 117.5 | |
| Ex. 4b | Hydrogenated Surfynol ® 104 | 10 | 50 | 147.5 | |
| Ex. 4c | Hydrogenated Surfynol ® 104 | 5 | 35 | 98.5 | |
| Ex. 4d | Hydrogenated Surfynol ® 104 | 5 | 50 | 135.5 | |
| Ex. 5a | Dibutyl malate | 10 | 35 | 87.5 | |
| Ex. 5b | Dibutyl malate | 10 | 50 | 121.5 | |
| Ex. 6a | Benzonitrile | 19 | 25.4 | 69.5 | Soluble in liquid $CO_2$ |
| Ex. 6b | Benzonitrile | 19 | 35.3 | 80.0 | |
| Ex. 7a | Acetonitrile | 20 | 23.7 | 70.6 | Soluble in liquid $CO_2$ |
| Ex. 7b | Acetonitrile | 20 | 34.0 | 131.2 | |
| Ex. 8a | Acetophenone | 10 | 34.9 | 82.3 | |
| Ex. 8b | Acetophenone | 28 | 24.6 | 68.3 | Soluble in liquid $CO_2$ |
| Ex. 9a | Tri-n-butyl-amine | 10 | 24.3 | 70.4 | Soluble in liquid $CO_2$ |
| Ex. 9b | Tri-n-butyl-amine | 10 | 35.2 | 78.2 | |
| Ex. 10a | Propionitrile | 19 | 23.9 | 71.2 | Soluble in liquid $CO_2$ |
| Ex. 10b | Propionitrile | 19 | 34.7 | 137.5 | |
| Ex. 11a | Methyl-ethyl-ketone | 20 | 24.7 | 68.2 | Soluble in liquid $CO_2$ |
| Ex. 11b | Methyl-ethyl-ketone | 20 | 34.9 | 128.5 | |
| Ex. 12 | Dynol ™ 604 | 5 | 24.7 | 157.5 | |
| Ex 12a | Silicone-based surfactant | 5 | 35.0 | 172.5 | |

Examples 13 Through 18

Solubility of Acetylenic Alcohol and Diol-Based Mixtures in Liquid and Supercritical $CO_2$ The process of Examples 1 through 12 is repeated using different mixtures of processing agents to determine their miscibility and solubility in liquid and supercritical $CO_2$. The solubility results are shown in Table IV. The results indicate that all mixtures except propionitrile-Dynol®604 (50/50) are soluble in liquid $CO_2$. The results also indicate that the mixtures are soluble in supercritical $CO_2$(SC—$CO_2$) at pressures less than 3400 psig (~235 bar) at all temperatures. In many cases, the pressure required to dissolve an acetylenic alcohol or diol-based mixture in liquid or supercritical $CO_2$ for a given weight percent and temperature is lower than the pressure required to render a fluorinated or silicone-based processing agent soluble at the same temperature and weight percent.

TABLE IV

Liquid and Supercritical $CO_2$ Solubility of Acetylenic Alcohol and Diol-Based Mixtures

| Example Number | Processing agent Mixture (wt/wt) | Mixture wt % in $CO_2$ | Temp. (° C.) | Average Pres. (bar) | Comments |
|---|---|---|---|---|---|
| 13a | Benzonitrile/Surfynol ® 61 (50/50) | 10 | 24.7 | 69.5 | Miscible in liquid $CO_2$ |
| 13b | Benzonitrile/Surfynol ® 61 (50/50) | 10 | 41.3 | 95.0 | |
| 13c | Benzonitrile/Surfynol ® 61 (50/50) | 10 | 60.5 | 138.0 | |
| 14a | Benzonitrile/Surfynol ® 420 (50/50) | 9 | 24.4 | 76.3 | Miscible in liquid $CO_2$ |
| 14b | Benzonitrile/Surfynol ® 420 (50/50) | 9 | 41.0 | 122.5 | |
| 14c | Benzonitrile/Surfynol ® 420 (50/50) | 9 | 60.0 | 163.2 | |
| 15a | Benzonitrile/Dynol ® 604 (50/50) | 9 | 24.1 | 71.5 | Miscible in liquid $CO_2$ |
| 15b | Benzonitrile/Dynol ® 604 (50/50) | 9 | 40.7 | 140.3 | |
| 15c | Benzonitrile/Dynol ® 604 (50/50) | 9 | 60.5 | 218.4 | |
| 15d | Benzonitrile/Dynol ® 604 (50/50) | 5 | 24.3 | 68.9 | Miscible in liquid $CO_2$ |
| 15e | Benzonitrile/Dynol ® 604 (50/50) | 5 | 41.0 | 133.6 | |
| 15f | Benzonitrile/Dynol ® 604 (50/50) | 5 | 60.0 | 205.5 | |
| 16a | Propionitrile/Surfynol ® 61 (50/50) | 10 | 24.3 | 70.0 | Miscible in liquid $CO_2$ |
| 16b | Propionitrile/Surfynol ® 61 (50/50) | 10 | 41.5 | 91.0 | |
| 16c | Propionitrile/Surfynol ® 61 (50/50) | 10 | 61.2 | 119.5 | |
| 16d | Propionitrile/Surfynol ® 61 (50/50) | 5 | 24.0 | 68.7 | Miscible in liquid $CO_2$ |

TABLE IV-continued

Liquid and Supercritical $CO_2$ Solubility of Acetylenic Alcohol and Diol-Based Mixtures

| Example Number | Processing agent Mixture (wt/wt) | Mixture wt % in $CO_2$ | Temp. (° C.) | Average Pres. (bar) | Comments |
|---|---|---|---|---|---|
| 16e | Propionitrile/Surfynol ® 61 (50/50) | 5 | 41.2 | 100.7 | |
| 16f | Propionitrile/Surfynol ® 61 (50/50) | 5 | 60.8 | 159.6 | |
| 17a | Propionitrile/Surfynol ® 420 (50/50) | 10 | 23.7 | 68.6 | Miscible in liquid $CO_2$ |
| 17b | Propionitrile/Surfynol ® 420 (50/50) | 10 | 41.5 | 106.0 | |
| 17c | Propionitrile/Surfynol ® 420 (50/50) | 10 | 61.0 | 140.0 | |
| 17d | Propionitrile/Surfynol ® 420 (50/50) | 5 | 24.9 | 69.7 | Miscible in liquid $CO_2$ |
| 17e | Propionitrile/Surfynol ® 420 (50/50) | 5 | 40.9 | 97.2 | |
| 17f | Propionitrile/Surfynol ® 420 (50/50) | 5 | 60.5 | 155.2 | |
| 18a | Propionitrile/Dynol ® 604 (50/50) | 11 | 41.0 | 149.5 | Insoluble in liquid $CO_2$ |
| 18b | Propionitrile/Dynol ® 604 (50/50) | 11 | 60.5 | 228.2 | Got cloudy slowly |
| 18c | Propionitrile/Dynol ® 604 (50/50) | 6 | 41.4 | 151.7 | Insoluble in liquid $CO_2$ |
| 18d | Propionitrile/Dynol ® 604 (50/50) | 6 | 60.3 | 232.3 | Got cloudy slowly |

Examples 19 Through 35

Photoresist Dissolution and Removal Results

For the following examples, mixtures of processing agents such as acetylenic alcohols, acetylenic diols, co-solvents, and chelating agents with either ultra-pure-water (UPW) or hexanes (primarily n-hexane) as the solvent were prepared. Hexanes are considered good "surrogate" solvents for supercritical $CO_2$ because the solubility parameters of n-hexane and supercritical $CO_2$ at 3000 psia and 50° C. are very similar. Experimental results also indicate that solvating power of the two solvents (supercritical $CO_2$ and n-hexane) differs by at most approximately 20%. The identity and amount of each processing agent in the mixture is provided in Table V. Centrifuge tubes were filled with 20 ml of each mixture and placed in a circulating bath at 35° C. for at least 10 minutes. Restored 4-inch diameter wafers supplied by Wafer Net were blown off with a high-pressure nitrogen gun to remove surface particulates and then measured using a Filmetrics F20 Thin Film Measurement System in three regions of the wafer. The measurements were then recorded and averaged.

Each wafer was coated with photoresist as follows. The wafer was placed in the center of a Headway Model 1-EC10D-R790 Precision Spin-coater vacuum chuck within an enclosed hood. A 2 ml amount of Sumitomo 193 nm AX4318 Resist was dispensed onto the center of the wafer. The hood sash was closed and the wafer was spun at 3500 RPM for 25 seconds. After the spin-coater stopped, the wafer was removed with wafer tweezers and put on a Thermolyne Type HP11500B Explosion Proof Hotplate for 60 seconds. The wafer was removed from the hotplate and allowed to cool for at least 10 minutes.

The film thickness of each wafer before dissolution was analyzed in three areas of the wafer and the results were recorded and averaged. The processed wafer was also visually examined to note any abnormalities. The photoresist-coated wafer was then placed in a Teflon® coated developer bath dish. A sample of each exemplary mixture was poured onto the wafer within the bath dish and the timer was started. After 10 minutes, the wafer was removed from the bath and rinsed with ultra high purity water or hexanes for sixty seconds. The front and back of each wafer was dried with a high-pressure nitrogen nozzle. The film thickness of each wafer after dissolution was analyzed in three areas and the results were recorded and averaged. The film thickness was also visually observed to note any abnormalities or changes, such as changes in color. In some instances, the results were independently verified using a quartz microbalance (QCM). The film thickness results are provided in Table V.

Film thickness measurements for examples 19 through 28, which were mixtures containing acetylenic alcohols, acetylenic diols, co-solvents, or chelating agents of the present invention, illustrate that these mixtures removed at least 60.45%, and in the majority of the examples removed approximately 100%, of the 193 nm photoresist from the surface of the substrate. By contrast, examples 29 through 35 show that co-solvents used in the prior art are not as efficient at removing 193 nm photoresist at equivalent molar concentrations.

TABLE V

Photoresist Dissolution and Stripping Studies Using Surrogate Solvents

| Example | Processing Agents | Molar % (wt %) Processing agent | % Resist Removal |
|---|---|---|---|
| 19 | Benzonitrile | 10.01% (17.15%) | 100% |
| 20 | Acetophenone | 10.08% (13.53%) | 100% |
| 21 | Amietol ® E-21 | 10.05% (42.09%) | 100% |
| 22 | Surfynol ® 61 | 10.15% (14.19%) | 75.26% |
| 23 | Hydrogenated Surfynol ® 104 | 10.0% (22.89%) | 100% |
| 24 | Dibutyl malate | 10.05% (24.22%) | 100% |
| 25 | Hexafluoropropanol-acetylene | 9.85% (19.42%) | 86.48% |
| 26 | 2-ethylaminoethanol | 9.39% (33.90%) | 70.84% |
| 27a | Acetonitrile | 10.01% (20.22%) | 0 |
| 27b | Acetonitrile | 25.10% (43.30%) | 100% |
| 28a | Propionitrile | 10.05% (7.0%) | 2.62% |
| 28b | Propionitrile | 19.19% (13.17%) | 60.45% |
| 29 | Methanol | 9.97% (16.44%) | <1% |
| 30 | Acetic Acid | 9.97% (26.97%) | <1% |
| 31 | Acetone | 10.01% (26.38%) | 0 |
| 32 | Propylene Glycol | 10.04% (32.04%) | <2% |
| 33 | n-methyl-pyrrolidinone (NMP) | 10.0% (37.97%) | 0 |

TABLE V-continued

Photoresist Dissolution and Stripping Studies Using Surrogate Solvents

| Example | Processing Agents | Molar % (wt %) Processing agent | % Resist Removal |
|---|---|---|---|
| 34 | Dimethyl acetamide | 10.06% (35.11%) | None |
| 35 | Ethyl acetate | 10.02% (10.22%) | <2% |

Examples 36 Through 55

Photoresist Stripping Test Results Using $CO_2$ as Dense Fluid and Acetylenic Alcohol and Diol-Based Formulations as Processing Agents The formulations shown in Table V were used to remove Sumitomo AX-4138 (193 nm) photoresist from the surface of thermal-oxide coated (990 nm thickness), 4-inch wafers provided by University Wafers. The wafers were prime grade wafer N-type <100> wafers. They were prepared as follows: (a) the wafers were dried at ~250° C. for 5 minutes under filtered nitrogen; (b) primed by exposing to HMDS vapor for 10 minutes at ambient temperature; (c) photoresist was applied and then spun-coated to achieve ~400 nm resist layer; (d) heated to 130° C. for 2 minutes (note: since the wafers were not exposed on a lithography tool, the post exposure bake at 110° C. was replaced by the hard bake conditions); (e) immersed in 0.26N TMAH developer solution for 60 seconds; (f) rinsed with UPW and dry with filtered $N_2$; and (g) heated to 130° C. for 2 minutes.

The thickness of the photoresist was measured before and after development. The results indicated that approximately 5 nm of resist was lost during the develop step (step (e) above). These wafers were blanket-etched to produce etched cross-linked photoresist. Five wafers were etched for 6.67 minutes and the remaining five wafers were etched for 10 minutes, resulting in resist thickness losses of approximately 220 and 350 nm respectively. The wafers were then divided into 1-inch square pieces and the thickness of each piece measured at five different locations (four corners and the center) prior to cleaning. The resist thickness of the pieces etched for 6.67 minutes was approximately 180 nm; the resist thickness of the pieces etched for 10 minutes was approximately 100 nm.

The pieces of etched wafers were then used in supercritical $CO_2$-based photoresist stripping tests. Process conditions and test results for several acetylenic alcohols and diols including Surfynol®420, Dynol®604, hydrogenated Surfynol®104, and Surfynol®61 with benzonitrile as a cosolvent are provided in Table VI. Similar results for propionitrile as a cosolvent are provided in Table VII. The $CO_2$ flow rate for all these cases was 1 liter/min. The processing agent represented 5 wt % of the dense cleaning fluid and comprised of an acetylenic alcohol, an acetylenic diol, a co-solvent (nitrile), or a mixture thereof. The co-solvent and/or acetylenic alcohol or diol were maintained in contact with the wafer for a total of four minutes soak time. After the soak was completed, the process chamber was rapidly depressurized using a two step procedure in which the pressure was decreased from 3300 psig to 1500 psig over a five second interval and then decreased from 1500 psig to atmospheric as fast as possible. The tests were conducted at a pressure of 3200 psig (~225 bar) and a temperature of 60° C. The wafers were rinsed in flowing supercritical $CO_2$ for 4 minutes subsequently to remove any traces of co-solvents and/or surfactant. The etched photoresist thickness was measured at five different locations on each wafer piece before and after exposing the wafer piece to the mixture containing supercritical $CO_2$, acetylenic alcohol or acetylenic diol, and/or co-solvent. A Filmetrics F20 Thin Film Measurement System was used to measure thickness.

The results show that formulations that comprise Surfynol®420, Dynol®604, hydrogenated Surfynol®104, and Surfynol®61 are particularly efficacious at removing etched photoresist. It was observed that photoresist and residue removal (as a percentage of the initial resist thickness) are relatively independent of initial thickness (etch time) and wafer position in the cleaning chamber. Although both co-solvents (benzonitrile or propionitrile) remove resist partially (~80%), there is a substantial decrease in photoresist thickness and increase in cleaning efficiency when acetylenic alcohols or diols are added to either cosolvent (benzonitrile or propionitrile), or when another processing agent such as dibutyl malate, is used with the co-solvents. Particularly effective cleaning formulations that successfully removed greater than 90% of the resist and resist residue include any mixture containing Surfynol®420, any mixture containing hydrogenated Surfynol®104, and any mixture containing Dynol®604. By contrast, the dense fluid (supercritical $CO_2$) alone removed less than 16% of the photoresist.

TABLE VI

Etched Photoresist Stripping Test Results with Supercritical $CO_2$, Benzonitrile, Acetylenic Alcohols and Diols, and Other Additives

| Ex. | Co-solvent (A) | Wt % (A) | Processing agent (B) | Wt % (B) | Temp. (° C.) | Press. (psig) | Contacting Mode | % Resist Removed |
|---|---|---|---|---|---|---|---|---|
| 36 | None | 0.0 | None | 0.0 | 40.0 | 3300.0 | Dynamic | 11.6 |
| 37 | None | 0.0 | None | 0.0 | 60.0 | 3300.0 | Dynamic | 15.7 |
| 38 | None | 0.0 | Surfynol ® 61 | 5.0 | 40.0 | 3300.0 | Dynamic | 50. |
| 39 | None | 0.0 | Surfynol ® 61 | 5.0 | 58.0 | 3274.0 | Static | 53.68 |
| 40 | Benzonitrile | 5.0 | None | 0.0 | 61.0 | 3215.0 | Static | 79.76 |
| 41 | Benzonitrile | 2.5 | Surfynol ® 61 | 2.5 | 59.0 | 3215.0 | Static | 80.08 |
| 42 | Benzonitrile | 2.5 | Surfynol ® 420 | 2.5 | 59.0 | 3215.0 | Static | 92.6 |
| 43a | Benzonitrile | 2.5 | Surfynol ® 420 | 2.5 | 57.0 | 3220.0 | Static | 85.78 |
| 43b | Benzonitrile | 2.5 | Surfynol ® 420 | 2.5 | 57.0 | 3220.0 | Static | 91.78 |
| 43c | Benzonitrile | 2.5 | Surfynol ® 420 | 2.5 | 57.0 | 3220.0 | Static | 94.24 |
| 43d | Benzonitrile | 2.5 | Surfynol ® 420 | 2.5 | 57.0 | 3220.0 | Static | 90.08 |
| 43e | Benzonitrile | 2.5 | Surfynol ® 420 | 2.5 | 57.0 | 3220.0 | Static | 90.24 |

TABLE VI-continued

Etched Photoresist Stripping Test Results with Supercritical $CO_2$, Benzonitrile, Acetylenic Alcohols and Diols, and Other Additives

| Ex. | Co-solvent (A) | Wt % (A) | Processing agent (B) | Wt % (B) | Temp. (° C.) | Press. (psig) | Contacting Mode | % Resist Removed |
|---|---|---|---|---|---|---|---|---|
| 44 | Benzonitrile | 2.5 | Surfynol ® 420 | 2.5 | 57.0 | 3191.0 | Static | 93.30 |
| 45 | Benzonitrile | 2.5 | Dynol ® 604 | 2.5 | 57.0 | 3215.0 | Static | 91.83 |
| 46 | Benzonitrile | 2.5 | Hydrogenated Surfynol ® 104 | 2.5 | 57.0 | 3191.0 | Static | 95.34 |
| 47 | Benzonitrile | 2.5 | Dibutyl malate | 2.5 | 58.0 | 3220.0 | Static | 87.87 |

TABLE VII

Etched Photoresist Stripping Test Results with Supercritical $CO_2$, Propionitrile, Acetylenic Alcohols and Diols, and Other Additives

| Ex. | Co-solvent (A) | Wt % (A) | Processing agent (B) | Wt % (B) | Temp. (° C.) | Press. (psig) | Contacting Mode | % Resist Removed |
|---|---|---|---|---|---|---|---|---|
| 48 | Propionitrile | 5.0 | None | 0.0 | 58.0 | 3222.0 | Static | 81.39 |
| 49 | Propionitrile | 2.5 | Surfynol ® 61 | 2.5 | 58.0 | 3229.0 | Static | 95.23 |
| 50 | Propionitrile | 2.5 | Surfynol ® 61 | 2.5 | 57.0 | 3191.0 | Static | 57.72 |
| 51 | Propionitrile | 2.5 | Surfynol ® 61 | 2.5 | 57.0 | 3191.0 | Static | 86.40 |
| 52 | Propionitrile | 2.5 | Surfynol ® 420 | 2.5 | 58.0 | 3220.4 | Static | 97.84 |
| 53 | Propionitrile | 2.5 | Dynol ® 604 | 2.5 | 58.0 | 3220.4 | Static | 86.48 |
| 54 | Propionitrile | 2.5 | Hydrogenated Suryfnol ® 104 | 2.5 | 58.0 | 3234.9 | Static | 95.23 |
| 55 | Propionitrile | 2.5 | Surfynol ® 420 | 2.5 | 57.0 | 3220.4 | Static | 94.15 |

Examples 56 Through 58

Photoresist Stripping by Dense Cleaning Fluids with the Use of Ultrasonic Waves An un-patterned silicon wafer was over-coated with a photoresist material, which was sensitive to the 193 nm wavelength of light. The over-coating was performed by spinning a selected amount of the photoresist onto a wafer, which was rotating at a known and predetermined rate. The over-coated wafer was then baked on a heated plate to a temperature of 130° C. for a period of 60 seconds to remove volatile solvents from the photoresist coating. The wafer was then fragmented into smaller samples. A surface reflectivity spectrometer manufactured by Filmetrics, Inc. of San Diego, Calif. was used to measure the resulting photoresist film thickness on the wafer samples. The photoresist film thickness was found to be approximately 400 nm on each wafer sample.

The samples were contacted with a dense cleaning fluid containing 4.5% by weight of Surfynol® 61 in a $CO_2$ dense fluid in a 500 ml reactor vessel. The samples were processed at a temperature of approximately 50° C. and a pressure of approximately 3000 psig for about 2 minutes. The temperature within the vessel was monitored and controlled using thermocouples connected to automatic power supplies for resistance heaters mounted on the vessel exterior. The pressure within the vessel was monitored using an electronic pressure gauge mounted on the vessel. $CO_2$ was supplied to the vessel using a high-pressure piston-type pump, which automatically controlled the reactor vessel pressure to the set point of 3000 psig. Surfynol® 61 was combined with the $CO_2$ stream as it flowed into the reactor vessel to form the dense cleaning fluid using a second piston-type pump. An in-line static mixer was used to ensure that the Surfynol® 61 and $CO_2$ were fully mixed before they entered the reactor vessel.

After the above pressure and temperature were reached, the wafer samples 57 and 58 were exposed to 20 KHz ultrasonic waves for a period of 60 seconds during immersion to provide impingement energy at the contaminated area. As a comparison sample wafer 56 was processed under the above conditions but not exposed to the ultrasonic waves. The vessel was then flushed with $CO_2$ and then de-pressurized and cooled to ambient conditions. After removal from the reactor vessel, the wafer samples were again examined under the reflectometer and the results are provided in Table VIII. As Table VIII illustrates, the process removed more than 93% of the photoresist film when ultrasonic waves were applied to the surface whereas only 88% of the film was removed without ultrasonic waves.

TABLE VIII

| Example | Duration of Exposure to Ultrasonic Waves | Film Thickness After Processing (nm) | % Removal of Photoresist Film |
|---|---|---|---|
| 56 | 0 | 50 | 88% |
| 57 | 60 | <30 | >93% |
| 58 | 60 | 9.6 | 98% |

The invention claimed is:

1. A dense cleaning fluid for removing contaminants from a substrate, the dense cleaning fluid comprising:

a dense fluid; and at least one derivatized etherified acetylenic alcohol or a derivatized etherified acetylenic diol wherein the derivatized alcohol or the derivatized diol comprises at least one interactive functional group selected from the group consisting of an amine, an acid, an ester, a nitrile, a carbonate, and combinations thereof.

2. The dense cleaning fluid of claim 1 wherein the derivatized etherified acetylenic alcohol or the derivatized etherified acetylenic diol is at least one member selected from the group consisting of compounds represented by Formulas (D) through (I):

Formula D

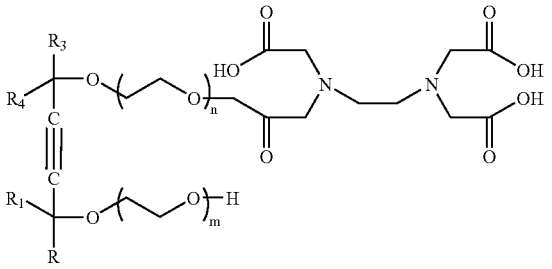

Formula E

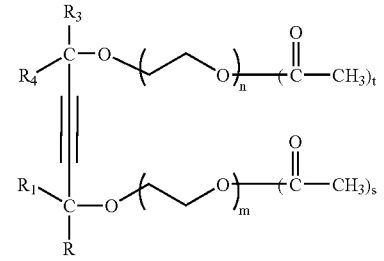

Formula F

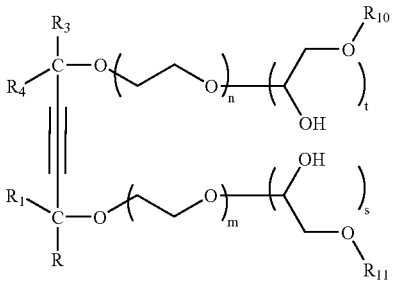

Formula G

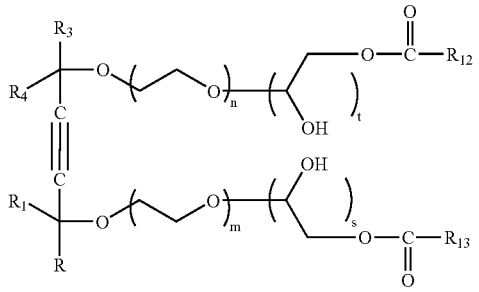

Formula H

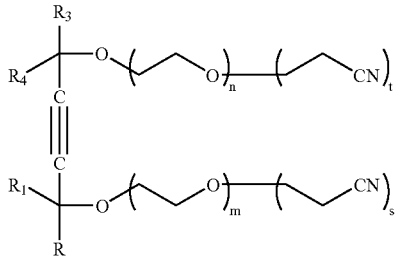

-continued

Formula I

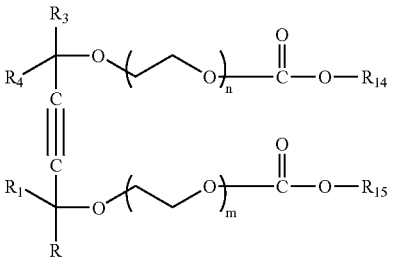

wherein R, $R_1$, $R_3$, and $R_4$ are independently a hydrogen atom, a linear alkyl group comprised of from 1 to 34 carbon atoms, or a branched alkyl group comprised of from 2 to 34 carbon atoms; $R_{10}$ and $R_{11}$ are each independently an alkyl group or a fluoroalkyl group comprised of from 1 to 34 carbon atoms; $R_{12}$, $R_{13}$, $R_{14}$, and $R_{15}$ are each independently an alkyl group comprised of from 1 to 34 carbon atoms; the value of m+n is a number ranging from 0 to 30 and the value of s+t is a number ranging from 1 to 2.

3. A method for removing contaminants from a substrate, the method comprising:

introducing the substrate comprising contaminants into a processing chamber;

contacting the substrate with a dense cleaning fluid comprising a dense fluid and at least one processing agent selected from the group consisting of a derivatized etherified acetylenic alcohol, a derivatized etherified acetylenic diol, and combinations thereof to provide a spent dense fluid and a treated substrate; and separating the contaminants and the at least one processing agent from the spent dense fluid, wherein the derivatized etherified alcohol or the derivatized etherified diol comprises at least one interactive functional group selected from the group consisting of an amine, an acid, an ester, a nitrile, a carbonate, and combinations thereof.

4. The method of claim 3 further comprising introducing ultrasonic energy into the processing chamber during at least a portion of the contacting step.

5. The method of claim 3 wherein a pressure of the contacting step ranges from 1000 to 8000 psig.

6. The method of claim 3 wherein a temperature of the contacting step ranges from 10 to 100° C.

7. A method for removing contaminants from a substrate, the method comprising:

introducing the substrate comprising contaminants into a processing chamber;

combining a dense fluid, at least one fluorinated dense fluid, and at least one processing agent to provide a dense cleaning fluid;

contacting the substrate with the dense cleaning fluid to provide a spent dense cleaning fluid and a treated substrate;

separating the contaminants and the at least one processing agent from the spent dense cleaning fluid; and separating at least one fluorinated dense fluid from the spent dense cleaning fluid wherein the at least one fluorinated dense fluid is purified to provide a purified fluorinated dense fluid and wherein at least a portion of the at least one fluorinated dense fluid in the combining step comprises the purified fluorinated dense fluid, wherein processing agent selected from the group consisting of a derivatized etherified acetylenic alcohol, a derivatized etherified acetylenic diol, and combinations thereof, wherein the derivatized etherified alcohol or the derivatized etherified diol comprises at least one interactive functional group selected from the group consisting of an amine, an acid, an ester, a nitrile, a carbonate, and combinations thereof.

8. The method of claim 7 further comprising depressurizing and/or heating the spent dense fluid to transform the spent dense fluid into a gaseous phase.

9. The method of claim 7 wherein a pressure of the contacting step ranges from 500 to 4000 psig.

10. The method of claim 7 wherein a temperature of the contacting step ranges from 35 to 100° C.

11. The method of claim 7 wherein the first separating step is conducted using at least one method selected from filtration, sedimentation, inertial separation, electrostatic precipitation, acoustic precipitation, condensation, thermal gradients, magnetic separation, flashing and combinations thereof.

12. The dense cleaning fluid of claim 1 wherein the dense fluid comprises one or more components selected from the group consisting of carbon dioxide, nitrogen, methane, oxygen, ozone, argon, hydrogen, helium, ammonia, nitrous oxide, hydrogen fluoride, hydrogen chloride, sulfur trioxide, sulfur hexafluoride, nitrogen trifluoride, monofluoromethane, difluoromethane, trifluoromethane, trifluoroethane, tetrafluoroethane, pentafluoroethane, perfluoropropane, pentafluoropropane, hexafluoroethane, hexafluoropropylene, hexafluorobutadiene, octafluorocyclobutane, and methyl fluoride.

13. The dense cleaning fluid of claim 12 wherein the dense fluid comprises carbon dioxide.

14. The dense cleaning fluid of claim 1 wherein the dense fluid comprises at least one fluorinated dense fluid selected from perfluorocarbon compounds, hydrofluorocarbons, fluorine-containing compounds, fluorinated nitriles, fluoroethers, fluoroamines, fluorinated gases, and combinations thereof.

* * * * *